US011183132B2

(12) United States Patent
Tamaki et al.

(10) Patent No.: US 11,183,132 B2
(45) Date of Patent: Nov. 23, 2021

(54) DISPLAY DEVICE

(71) Applicant: Japan Display Inc., Minato-ku (JP)

(72) Inventors: Masaya Tamaki, Tokyo (JP); Tsutomu Harada, Tokyo (JP); Hirotaka Hayashi, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 17/014,628

(22) Filed: Sep. 8, 2020

(65) Prior Publication Data

US 2020/0402473 A1 Dec. 24, 2020

Related U.S. Application Data

(63) Continuation of application No. 16/380,334, filed on Apr. 10, 2019, now Pat. No. 10,810,956, which is a (Continued)

(30) Foreign Application Priority Data

Mar. 26, 2015 (JP) ..... 2015-064454

(51) Int. Cl.
*G09G 3/36* (2006.01)

(52) U.S. Cl.
CPC ..... *G09G 3/3614* (2013.01); *G09G 3/3688* (2013.01); *G09G 2300/0426* (2013.01); (Continued)

(58) Field of Classification Search
CPC ..... G09G 3/3614; G09G 3/3688; G09G 2300/0426; G09G 2300/0452; (Continued)

(56) References Cited

U.S. PATENT DOCUMENTS 8,587,504 B2 * 11/2013 Joo ..... G09G 3/3614 345/90
2008/0309837 A1 12/2008 Abe
(Continued)

FOREIGN PATENT DOCUMENTS

CN 1547731 A 11/2004
CN 1797528 A 7/2006
(Continued)

OTHER PUBLICATIONS

Combined Chinese Office Action and Search Report dated Nov. 2, 2018 in corresponding Chinese Patent Application No. 201610178278.7 (with English Translation), 17 pages.
(Continued)

*Primary Examiner* — Brent D Castiaux
(74) *Attorney, Agent, or Firm* — Oblon, McClelland, Maier & Neustadt, L.L.P.

(57) ABSTRACT

According to one embodiment, a display device, includes a first pixel line including a first sub-pixel and a second sub-pixel, a second pixel line including a third sub-pixel and a fourth sub-pixel, and a display driver supplying video signals which cause signal polarities of signal lines adjacent to each other to be opposite to each other, without varying the polarities in one frame period, the video signals having the same polarities as each other being written to the respective sub-pixels of the first pixel line, the video signals having the polarities which are the same as each other and opposite to the polarities of the video signals written to the first pixel line, being written to the respective sub-pixels of the second pixel line.

12 Claims, 18 Drawing Sheets

Related U.S. Application Data continuation of application No. 15/068,684, filed on Mar. 14, 2016, now Pat. No. 10,332,465.

(52) U.S. Cl.
CPC ..... *G09G 2300/0452* (2013.01); *G09G 2310/0205* (2013.01); *G09G 2310/0297* (2013.01)

(58) Field of Classification Search
CPC .... G09G 2310/0205; G09G 2310/0297; G02F 1/13306; G02F 1/136286
See application file for complete search history.

(56) References Cited

U.S. PATENT DOCUMENTS

| | | | | |
|---|---|---|---|---|
| 2009/0273550 | A1 | 11/2009 | Vieri | |
| 2012/0320026 | A1* | 12/2012 | Kitayama ..... | G09G 3/36 345/212 |
| 2013/0050282 | A1 | 2/2013 | Kim et al. | |
| 2013/0120470 | A1 | 5/2013 | Djordjev | |
| 2013/0256707 | A1* | 10/2013 | Chiang ..... | G02F 1/1368 257/88 |
| 2014/0160172 | A1 | 6/2014 | Lee | |
| 2015/0187293 | A1* | 7/2015 | Yoo ..... | G09G 3/3614 345/694 |
| 2015/0212376 | A1 | 7/2015 | Hayashi | |

FOREIGN PATENT DOCUMENTS

| | | | |
|---|---|---|---|
| CN | 202330943 | U | 7/2012 |
| CN | 102725676 | A | 10/2012 |
| CN | 102749777 | A | 10/2012 |
| JP | 2002-62536 | | 2/2002 |
| JP | 2004-118048 | | 4/2004 |
| JP | 2011-227140 | | 11/2011 |
| JP | 2015-141326 | | 8/2015 |

OTHER PUBLICATIONS

Combined Chinese Office Action and Search Report dated Sep. 2, 2019 in Chinese Patent Application No. 201610178278.7 (with unedited computer generated English translation), 10 pages.

* cited by examiner

DISPLAY DEVICE

CROSS-REFERENCE TO RELATED APPLICATIONS

This application is a continuation of U.S. application Ser. No. 16/380,334 filed Apr. 10, 2019, which is a continuation of U.S. application Ser. No. 15/068,684 filed Mar. 14, 2016, and is based upon and claims the benefit of priority from Japanese Patent Application No. 2015-064454, filed Mar. 26, 2015, the entire contents of each of which are incorporated herein by reference.

FIELD

Embodiments described herein relate generally to a display device.

BACKGROUND

In a liquid crystal display device in a mode of electrically controlled birefringence (ECB) or the like, liquid crystal molecules are undesirably influenced by a lateral electric field due to a relationship between the polarities of adjacent pixels and the rubbing direction of an alignment film, and disclination of the alignment of the liquid crystal molecules occurs in an area in part. The disclination needs to be eliminated since it causes various display failures such as image lag, blurring, reduction in a contrast ratio and the like when an image is displayed.

Use of a light-shielding film or the like to block the light on a portion where the disclination occurs is the most dependable method, but a problem arises in that an area of an opening portion which contributes to the display is reduced as the light-shielding film is extended. Rubbing a pixel polarity in a direction in which no disclination occurs, applying a line-inversion drive scheme, and the other methods for dealing with this problem are also well known.

In a reflective liquid crystal display device, for example, the reflectivity and the contrast ratio (CR) are varied according to the azimuth of observation. Even if the rubbing direction is set under conditions under which the optical properties such as reflectivity and contrast ratio are optimized, disclination occurs because of the influence of the lateral electric field between adjacent pixels having different polarities when the column-inversion drive scheme is applied. For this reason, it is desirable to use the line-inversion drive scheme to suppress the occurrence of the disclination. However, the use of the line-inversion drive scheme of supplying video images having their polarities inverted in each one or more pixel lines for the same signal line has a problem in that the energy consumption is increased in comparison with the use of the column-inversion drive scheme of supplying video signals of the same polarity to the same signal line in one frame period.

DETAILED DESCRIPTION

Figure 1:
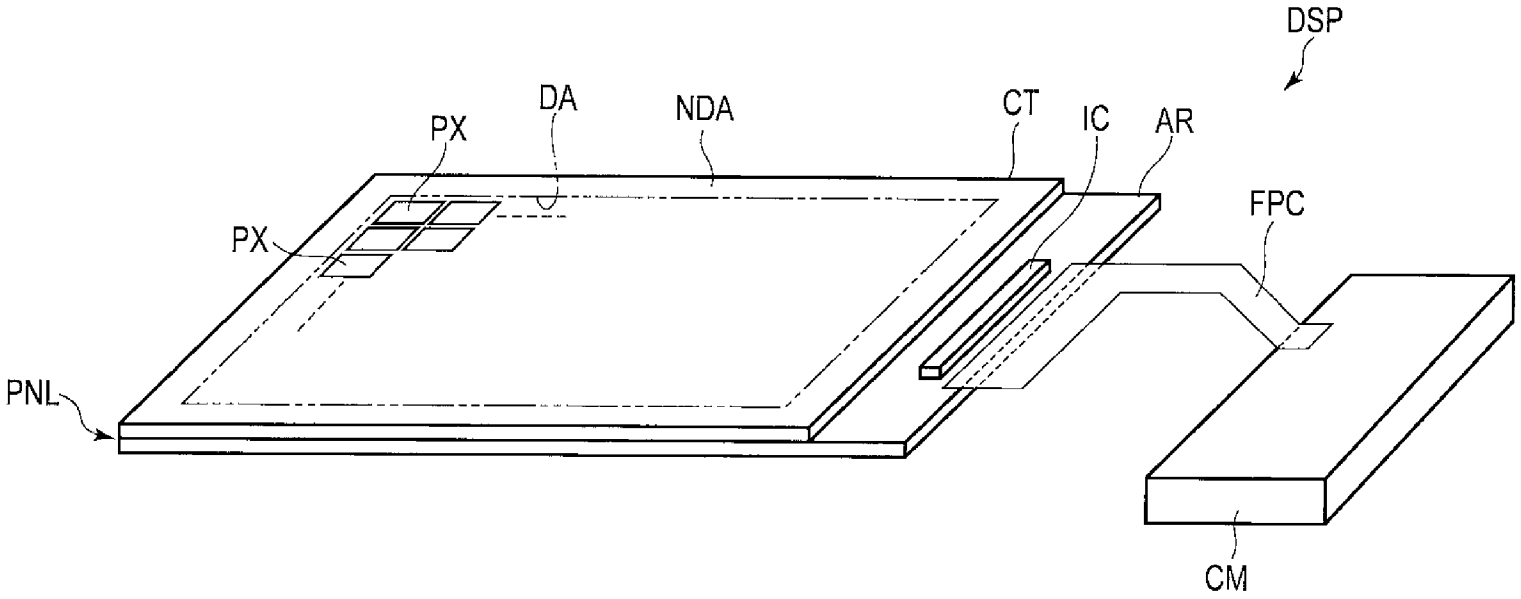
FIG. 1 is a perspective view schematically showing a configuration of a liquid crystal display device DSP.

In general, according to one embodiment, a display device, includes: a first pixel line including a first sub-pixel and a second sub-pixel arranged in a first direction; a second pixel line arranged in a second direction of the first pixel line and including a third sub-pixel and a fourth sub-pixel arranged in the first direction; a scanning line group including a plurality of scanning lines; a signal line group including a plurality of signal lines; and a display driver producing a video signal to be written to each of the sub-pixels of the first and second pixel lines and supplying the video signal to each of the sub-pixels via the signal lines, the display driver supplying the video signals which cause signal polarities of the signal lines adjacent to each other to be opposite to each other, without varying the polarities in one frame period, the video signals having the same polarities as each other being written to the respective sub-pixels of the first pixel line, the video signals having the polarities which are the same as each other and opposite to the polarities of the video signals written to the first pixel line, being written to the respective sub-pixels of the second pixel line.

Embodiments will be described hereinafter with reference to the accompanying drawings. The disclosure is merely an example, and proper changes within the spirit of the invention, which can easily be conceived by a person of ordinary skill in the art, naturally falls within the scope of invention. In addition, in some cases, in order to make the description clearer, the widths, thicknesses, shapes and the like of the respective parts are schematically illustrated in the drawings, as compared to the actual modes. However, the schematic illustration is merely exemplary, and adds no restrictions to the interpretation of the invention. Furthermore, in the specification and drawings, constituent elements having the same or similar functions as those described in connection with preceding drawings are denoted by like reference numerals and duplicated detailed explanations may be arbitrarily omitted.

In the present embodiment, a liquid crystal display device is described as an example of the display device. The liquid crystal display device can be used in, for example, various types of equipment such as smartphones, tablet terminals, mobile telephone terminals, personal computers, TV receivers, in-car equipment, and game consoles. The major configuration explained in the present embodiment can also be applied to a self-luminous display device comprising an organic electroluminescent display element, and the like, an electronic paper display device comprising a cataphoretic element, and the like, a display device employing microelectromechanical systems (MEMS), or a display device employing electrochromism.

FIG. 1 is a perspective view schematically showing a configuration of a liquid crystal display device DSP.

The liquid crystal display device DSP comprises an active-matrix liquid crystal display panel PNL, a driving IC chip IC which drives the liquid crystal display panel PNL, a control module CM, a flexible printed-circuit board FPC and the like.

The liquid crystal display panel PNL includes an array substrate (first substrate) AR and a counter-substrate (second substrate) CT disposed to be opposed to the array substrate AR. The liquid crystal display panel PNL includes a display area DA in which an image is displayed and a frame-shaped non-display area NDA surrounding the display area DA. The liquid crystal display panel PNL includes a plurality of main pixels (or unit pixels) PX arrayed in a matrix in the display area DA. The driving IC chip IC is mounted on the array substrate AR. The flexible printed-circuit board FPC connects the liquid crystal display panel PNL with the control module CM.

For example, the liquid crystal display panel PNL is a reflective display panel having a reflective display function of displaying an image by selectively reflecting light incident from the display surface side, such as external light and auxiliary light on each of the main pixels PX. In the reflective liquid crystal display panel PNL, a front light unit may be disposed as an auxiliary light source, on a side opposed to the counter-substrate CT. The liquid crystal display panel PNL may be a transmissive display panel having a transmissive display function to display an image by selectively transmitting the light from a backlight unit disposed on a back surface side of the array substrate AR by each main pixel PX or a transreflective display panel having a transmissive display function and a reflective display function.

For example, the main pixel PX which is a minimum unit constituting a color image includes a sub-pixel PR displaying a red color, a sub-pixel PG displaying a green color, and a sub-pixel PB displaying a blue color, as explained later. The main pixel PX may further include sub-pixels of the other colors (for example, yellow, pale blue, pale red, substantially transparent, white and the like).

Figure 2:
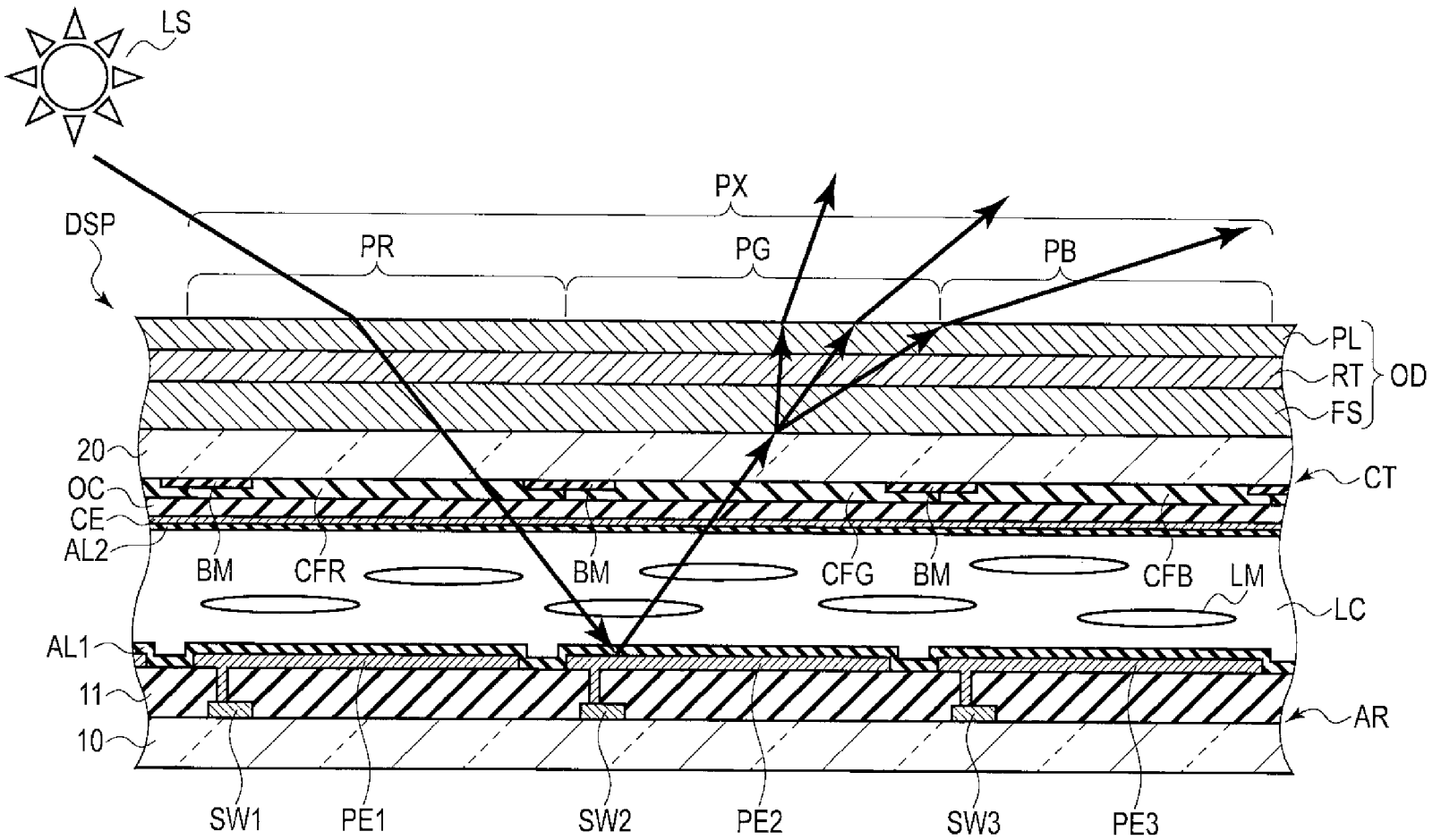
FIG. 2 is a schematic view showing a cross-section of the liquid crystal display panel DSP.

FIG. 2 is a schematic view showing a cross-section of the liquid crystal display panel DSP. The liquid crystal display device DSP comprising the reflective liquid crystal display panel PNL, in which one main pixel PX includes the sub-pixels PR, PG and PB, will be explained here.

The liquid crystal display device DSP comprises the array substrate AR, the counter-substrate CT, a liquid crystal layer LC, and an optical element OD.

The array substrate AR includes a first insulating substrate 10, switching elements SW1 to SW3, an interlayer insulating film 11, pixel electrodes (reflecting electrodes) PE1 to PE3, a first alignment film AL1 and the like. The switching elements SW1 to SW3 are formed on a side of the first insulating substrate 10, which is opposed to the counter-substrate CT. The switching element SW1 is disposed on the sub-pixel PR, the switching element SW2 is disposed on the sub-pixel PG, and the switching element SW3 is disposed on the sub-pixel PB. The interlayer insulating film 11 covers the switching elements SW1 to SW3 and the first insulating substrate 10. The pixel electrodes PE1 to PE3 are formed on a side of the interlayer insulating film 11, which is opposed to the counter-substrate CT. Each of the pixel electrodes PE1 to PE3 includes a reflective layer formed of, for example, a metal material such as aluminum or silver which has a light reflection property. The pixel electrodes PE1 to PE3 or reflective layers have substantially flat surfaces (specular surfaces). The pixel electrode PE1 is disposed in the sub-pixel PR and electrically connected with the switching element SW1. The pixel electrode PE2 is disposed in the sub-pixel PG and electrically connected with the switching element SW2. The pixel electrode PE3 is disposed in the sub-pixel PB and electrically connected with the switching element SW3. The first alignment film AL1 covers the pixel electrodes PE1 to PE3 and the interlayer insulating film 11.

The counter-substrate CT includes a second insulating substrate 20, a light-shielding layer BM, color filters CFR, CFG and CFB, an overcoat layer OC, a common electrode CE, a second alignment film AL2, and the like. The light-shielding layer BM is formed on a side of the second insulating substrate 20, which is opposed to the array substrate AR. The color filters CFR, CFG and CFB are formed on a side of the second insulating substrate 20, which is opposed to the array substrate AR, and partially overlap the light-shielding layer BM. The color filter CFR is a red color filter disposed in the sub-pixel PR and opposed to the pixel electrode PE1. The color filter CFG is a green color filter disposed in the sub-pixel PG and opposed to the pixel electrode PE2. The color filter CFB is a blue color filter disposed in the sub-pixel PB and opposed to the pixel electrode PE3. If the main pixel PX further includes a sub-pixel of the other color, a color filter of the corresponding color is disposed in the sub-pixel. For example, the main pixel PX may further include a color filter of yellow, pale blue or pale red or a substantially transparent or white color filter as a color filter of the other color different from red, green and blue. The color filters CF are disposed to correspond to the sub-pixels which exhibit the respective colors. The overcoat layer OC covers the color filters CF. The common electrode CE is formed on a side of the overcoat layer OC, which is opposed to the array substrate AR. The common electrode CE is disposed over the entire area of the main pixel PX and opposed to the pixel electrodes PE1 to PE3. The common electrode CE is formed of a transparent conductive material such as indium tin oxide (ITO) or indium zinc oxide (IZO). The second alignment film AL2 covers the common electrode CE.

The array substrate AR and the counter-substrate CT are adhered to each other such that the first alignment film AL1 and the second alignment film AL2 are opposed to each other. The liquid crystal layer LC is held between the array substrate AR and the counter-substrate CT, and includes liquid crystal molecules LM located between the first alignment film AL1 and the second alignment film AL2.

The optical element OD is disposed on a side opposite to a surface of the counter-substrate CT, which is in contact with the liquid crystal layer LC. The optical element OD includes, for example, a forward-scattering film FS, a retardation film RT, a polarizer PL and the like. The forward-scattering film FS is adhered to, for example, the second insulating substrate 20. The forward-scattering film FS has a function of transmitting light incident from a specific direction (i.e., a light source LS side in the figure) and scattering light incident from the other specific direction, as shown in the figure. A plurality of forward-scattering films FS should desirably be stacked for the purpose of extending the range of diffusion, preventing rainbow hues and the like. The retardation film RT is stacked on the forward-scattering film FS. The retardation film RT is a quarter-wave plate. For example, the retardation film RT is constituted by stacking a quarter-wave plate and a half-wave plate so as to reduce a wavelength dependency and obtain a desired phase difference within a wavelength range used for color display. The polarizer PL is stacked on the retardation film RT. The forward-scattering film FS may not only be located at the position shown in the figure, but may also be stacked on the polarizer PL.

Next, an example of optimization of an alignment direction AP1 of the first alignment film AL1 and an alignment direction AP2 of the second alignment film AL2 will be explained.

Figure 3:
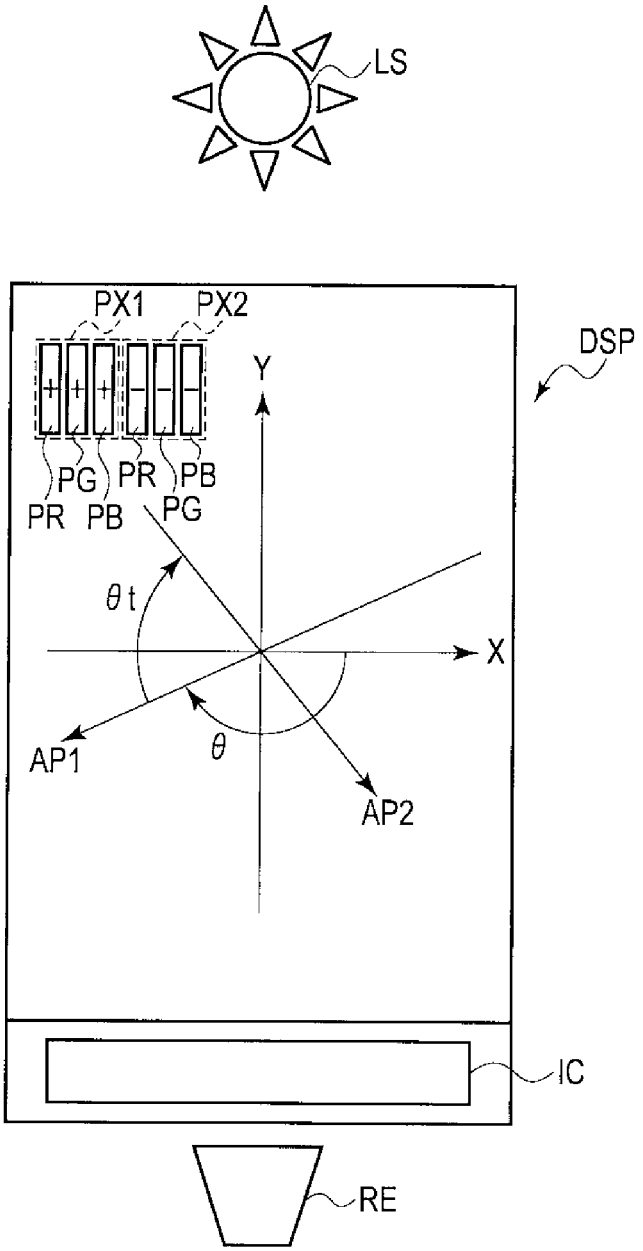
FIG. 3 is an illustration for explanation of a relationship between the alignment direction AP1 of the first alignment film AL1 and the alignment direction AP2 of the second alignment film AL2.

FIG. 3 is an illustration for explanation of a relationship between the alignment direction AP1 of the first alignment film AL1 and the alignment direction AP2 of the second alignment film AL2. A shorter-side direction of the display device DSP is referred to as a first direction X, a longer-side direction of the display device DSP is referred to as a second direction Y, and the first direction X and the second direction Y are assumed to be orthogonal to each other. A clockwise angle between the first direction X and the alignment direction AP1 is represented by θ and a twist angle of the liquid crystal molecules defined by the alignment direction AP1 and the alignment direction AP2 is represented by θt. The driving IC chip IC is located on the negative side in the second direction Y. It is assumed that the main pixel PX1 and the main pixel PX2 are arranged in the first direction X and that the polarity of the main pixel PX1 is opposite to the polarity of the main pixel PX2, in the display device DSP. Each of the main pixel PX1 and the main pixel PX2 includes the sub-pixels PR, PG, and PB arranged in the first direction X.

In the display device DSP, the following experiment was conducted. The reflectivity and the contrast ratio were measured in a situation that the light source LS was fixed on a positive side in the second direction Y shown in the figure, a light receiving portion RE was fixed on a negative side in the second direction Y shown in the figure, and the display device DSP was rotated clockwise in the X-Y plane defined by the first direction X and the second direction Y. The twist angle θt was set at 70° and the angle θ corresponded to the angle of rotation set for rotation of the display device DSP. The measurement of the reflectivity and the contrast ratio was conducted within the range of the angle (or the angle of rotation) from 0 to 360°.

Figure 4:
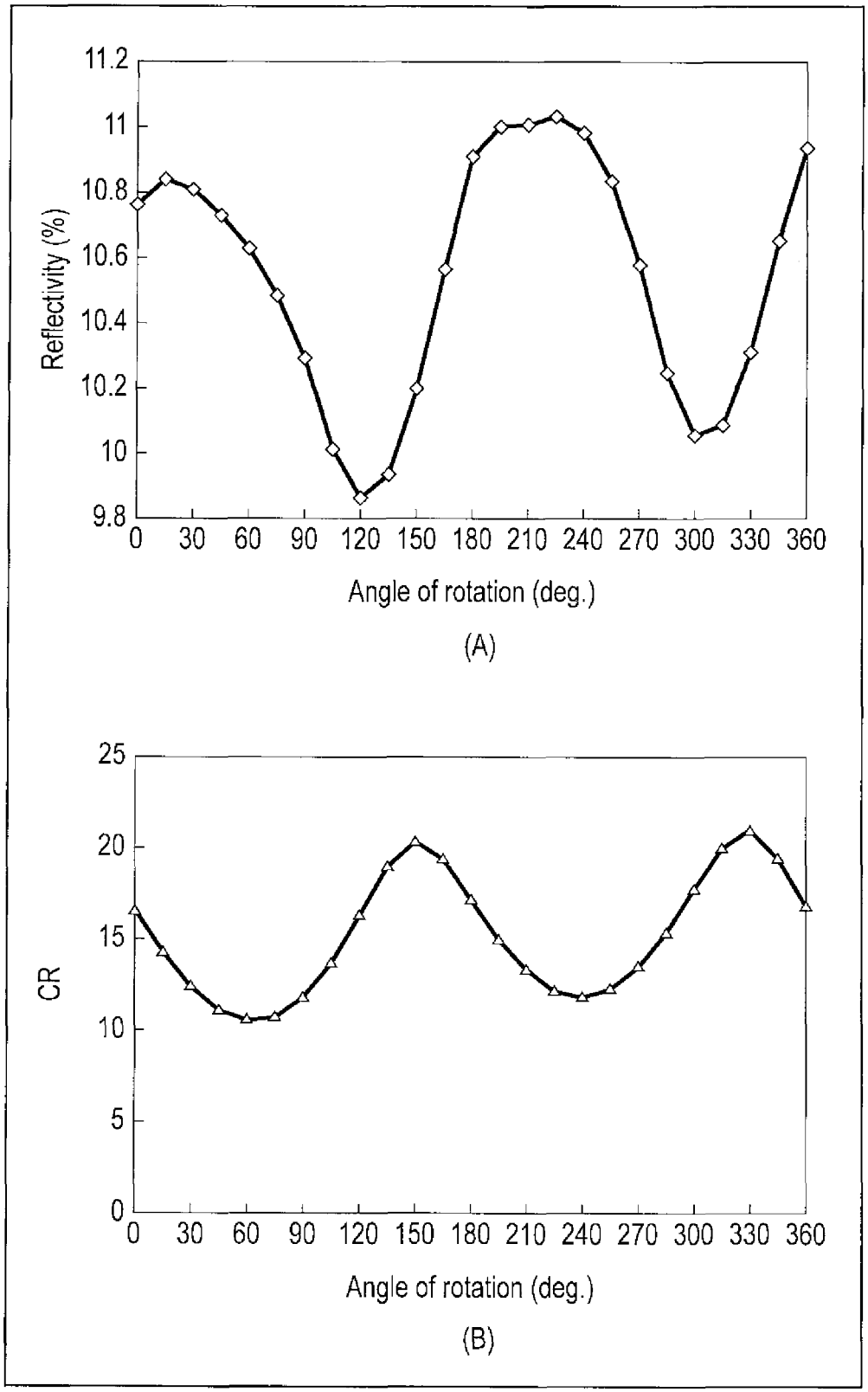
FIG. 4 shows experiment results and, more specifically, (A) shows a measurement result of the reflectivity (%) to the angle of rotation θ and (B) shows a measurement result of the contrast ratio to the angle of rotation θ.

FIG. 4 shows experiment results and, more specifically, (A) shows a measurement result of the reflectivity (%) to the angle of rotation θ and (B) shows a measurement result of the contrast ratio to the angle of rotation θ. As shown in the figure, the angle of rotation at which a high reflectivity can be obtained does not necessarily correspond to the angle of rotation at which a high contrast ratio can be obtained. It was recognized based on the experiment results shown in the figure that the optical properties such as the reflectivity and the contrast ratio became preferable when the angle of rotation was greater than 150° and smaller than 180°. The angle of rotation θ was set at 158.5° as one of the conditions for optimizing the optical properties. In contrast, the column-inversion drive scheme in which the polarities of the main pixels adjacent in the first direction X were different from each other was applied to the experiment. No display failure resulting from the disclination was recognized when the angle of rotation θ was set at 68.5°, but the display failure resulting from the disclination was recognized when the angle of rotation θ was set at 158.5°. In other words, the angle of rotation θ for optimizing the optical properties such as the reflectivity and the contrast ratio did not match the angle of rotation θ for suppressing the disclination.

In the present embodiment, a method of suppressing the disclination while setting the angle of rotation θ (=158.5°) for optimizing the optical properties will be reviewed. The disclination may often occur when the polarities of the pixels adjacent in the first direction X are different from each other. For this reason, the disclination can be suppressed by applying the line-inversion drive scheme in which the polarities of the pixels arranged in the first direction X are the same as each other. However, the line-inversion drive scheme has a problem in that the energy consumption is increased in comparison with the column-inversion drive scheme. For this reason, improvement of the display quality and reduction of the energy consumption based on optimization of the optical properties and suppression of the disclination can be achieved by applying the pseudo-line-inversion drive scheme of making the polarities of the pixels arranged in the first direction X similar to each other while substantially using the column-inversion drive scheme. Several specific methods for doing this will be explained below.

Figure 5:
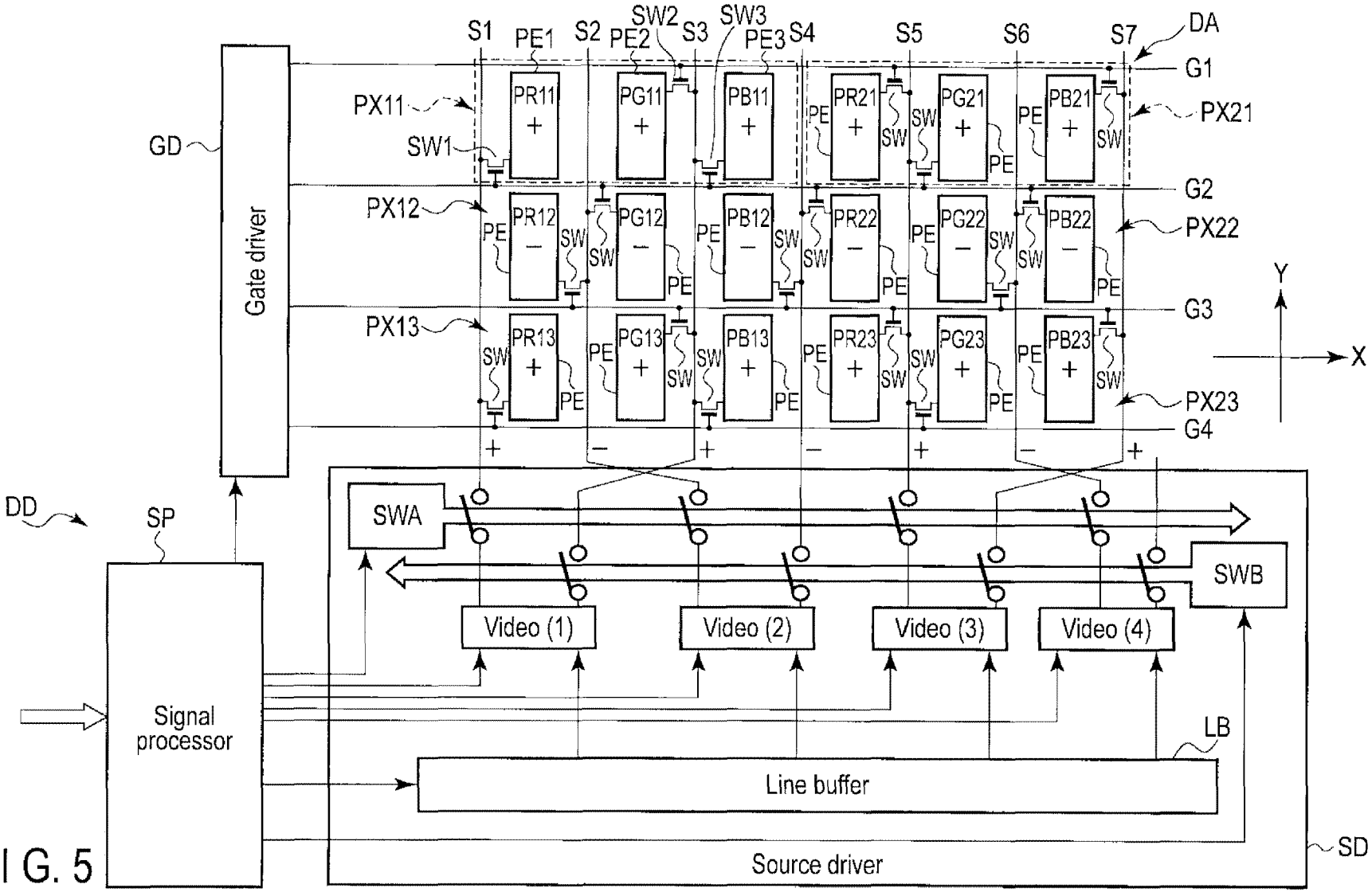
FIG. 5 is a diagram schematically showing an example of a pixel layout in the display area, and a configuration for writing a video signal to each pixel.

FIG. 5 is a diagram schematically showing an example of a pixel layout in the display area, and a configuration for writing a video signal to each pixel.

A part of the display area DA shown in the figure includes a scanning line group including a plurality of scanning lines G1 to G4, a signal line group including a plurality of signal lines S1 to S7, and a plurality of main pixels PX. In the pixel layout shown in the figure, some main pixels in the display area, i.e., main pixels PX11 to PX13 and PX21 to PX23 are shown. The main pixels PX11 to PX13 and PX21 to PX23 are arranged in the second direction Y, and the main pixels PX11 and PX21, PX12 and PX22, and PX13 and PX23 are arranged in the first direction X. When the main pixel PX11 is noticed, the main pixel PX11 includes sub-pixels PR11, PG11 and PB11. Each of the other main pixels similarly includes three sub-pixels. In the figure, PRn, PGn and PBn indicate a red sub-pixel, a green sub-pixel and a blue sub-pixel, respectively, in each main pixel PXn, where n indicates a positive integer.

In the example illustrated, the sub-pixels PR11, PG11, PB11, PR21, PG21 and PB21 are located between the scanning lines G1 and G2, and arranged in the first direction X. The sub-pixels PR12, PG12, PB12, PR22, PG22 and PB22 are located between the scanning lines G2 and G3, and arranged in the first direction X. The sub-pixels PR11 and PR12 are located between the signal lines S1 and S2, and arranged in the second direction Y. The sub-pixels PG11 and PG12 are located between the signal lines S2 and S3, and arranged in the second direction Y. The sub-pixels PB11 and PB12 are located between the signal lines S3 and S4, and arranged in the second direction Y. The sub-pixels PR21 and PR22 are located between the signal lines S4 and S5, and arranged in the second direction Y. The sub-pixels PG21 and PG22 are located between the signal lines S5 and S6, and arranged in the second direction Y. The sub-pixels PB21 and PB22 are located between the signal lines S6 and S7, and arranged in the second direction Y. Each of the sub-pixels shown in the figure is in a longitudinally elongated shape (rectangular shape) extending in the second direction Y. In addition, the sub-pixels shown in the figure are formed in the same size, but some of the sub-pixels may be formed to be larger or smaller than the other sub-pixels.

The scanning lines G1 to G4 extend substantially along the first direction X so as to be arranged in the second direction Y. The signal lines S1 to S7 extend substantially along the second direction Y so as to be arranged in the first direction X. When the main pixel PX11 is noticed, the sub-pixel PR11 includes the switching element SW1 and the pixel electrode PE1. The switching element SW1 is electrically connected with the scanning line G2 and the signal line S1. The pixel electrode PE1 is electrically connected with the switching element SW1. The sub-pixel PG11 comprises the switching element SW2 and the pixel electrode PE2. The switching element SW2 is electrically connected with the scanning line G1 and the signal line S3. The pixel electrode PE2 is electrically connected with the switching element SW2. The sub-pixel PB11 comprises the switching element SW3 and the pixel electrode PE3. The switching element SW3 is electrically connected with scanning line G2 and the signal line S3. The pixel electrode PE3 is electrically connected with the switching element SW3.

Similarly, in the main pixel PX21, the switching element SW of the sub-pixel PR21 is electrically connected with the scanning line G1, the signal line S5 and the pixel electrode PE, the switching element SW of the sub-pixel PG21 is electrically connected with the scanning line G2, the signal line S5 and the pixel electrode PE, and the switching element SW of the sub-pixel PB21 is electrically connected with the scanning line G1, the signal line S7 and the pixel electrode PE. The main pixels arranged in the first direction X are constituted similarly to the above-explained main pixels PX11 and PX21. The main pixel PX13 is constituted similarly to the main pixel PX11, and the main pixel PX23 is constituted similarly to the main pixel PX21.

In the main pixel PX12, the switching element SW of the sub-pixel PR12 is electrically connected with the scanning line G3, the signal line S2 and the pixel electrode PE, the switching element SW of the sub-pixel PG12 is electrically connected with the scanning line G2, the signal line S2 and the pixel electrode PE, and the switching element SW of the sub-pixel PB12 is electrically connected with the scanning line G3, the signal line S4 and the pixel electrode PE. In the main pixel PX22, the switching element SW of the sub-pixel PR22 is electrically connected with the scanning line G2, the signal line S4 and the pixel electrode PE, the switching element SW of the sub-pixel PG22 is electrically connected with the scanning line G3, the signal line S6 and the pixel electrode PE, and the switching element SW of the sub-pixel PB22 is electrically connected with the scanning line G2, the signal line S6 and the pixel electrode PE.

Of the pixel lines composed of the main pixels arranged in the first direction X, for example, odd-numbered pixel lines are constituted similarly to the main pixels PX11 and PX21, and even-numbered pixel lines are constituted similarly to the main pixels PX12 and PX22.

A display driver DD supplies various signals to display images to the display area DA of the pixel layout. The display driver DD comprises a signal processor SP, a gate driver GD, a source driver SD and the like. The signal processor SP processes input signals from the outside and controls the gate driver GD, the source driver SD and the like. In addition, the signal processor SP produces a video signal which should be written to each sub-pixel. The scanning lines G1 to G4 are connected to the gate driver GD. The gate driver GD sequentially outputs control signals to the scanning lines G1 to G4, under control of the signal processor SP. The signal lines S1 to S7 are connected to the source driver SD. The source driver SD comprises output terminals Video (1) to Video (4) which output the video signals produced by the signal processor SP to the respective signal lines S1 to S7.

More specifically, the line buffer LB is built in the source driver SD. In the source driver SD, the output terminals Video (1) to Video (4) are electrically connected with the line buffer LB and the signal processor SP. In addition, the output terminal Video (1) is electrically connected with the signal lines S1 and S3, the output terminal Video (2) is electrically connected with the signal lines S2 and S4, the output terminal Video (3) is electrically connected with the signal lines S5 and S7, and the output terminal Video (4) is electrically connected with the signal line S6 and a signal line S8 (not shown). A switch SWA which is switched to be on (conductive state) or off (nonconductive state) in the same period is interposed between the signal line S1 and the output terminal Video (1), between the signal line S2 and the output terminal Video (2), between the signal line S5 and the output terminal Video (3), and between the signal line S6 and the output terminal Video (4). A switch SWB which is switched to be on (conductive state) or off (nonconductive state) in the same period is interposed between the signal line S3 and the output terminal Video (1), between the signal line S4 and the output terminal Video (2), between the signal line S7 and the output terminal Video (3), and between the signal line S8 and the output terminal Video (4). The switches SWA and SWB are controlled to be on and off by, for example, the signal processor SP.

The signal processor SP outputs some of the video signals to the output terminals Video (1) to Video (4) while outputting the other video signals to the line buffer LB. The line buffer LB temporarily stores the video signals input from the signal processor SP. For example, the signal processor SP produces video signals for one pixel line and outputs the video signals for a half pixel line to the output terminals Video (1) to Video (4) while outputting the video signals for a remaining half pixel line to the line buffer LB and temporarily storing the video signals in the line buffer LB.

For this reason, the line buffer LB may have a storage capacity to store at least video signals for a half pixel line. Outputting the video signals will be explained later.

In this configuration, the polarities of the video signals output to the respective signal lines S1 to S7, in one frame period, are not varied, and the polarities of the video signals output to adjacent signal lines are opposite. In the example illustrated, the polarities of the video signals output to the odd-numbered signal lines S1, S3, S5 and S7 are positive (+) and the polarities of the video signals output to the even-numbered signal lines S2, S4, S6 and S8 are negative (−), in a certain frame period. In one frame period subsequent to the frame period shown in the figure, polarities of the video signals output to the odd-numbered signal lines are negative (−), and polarities of the video signals output to the even-numbered signal lines are positive (+). In other words, the column-inversion drive scheme is applied to the present configuration.

In contrast, the polarities of the video signals written to the respective pixel lines are the same, and the polarities of the video signals of adjacent pixel lines are opposite, in the frame period shown in the figure. In the example illustrated, the polarities of the video signals written to the sub-pixels of the odd-numbered pixel lines, for example, the sub-pixels PR11, PG11, PB11, PR21, PG21 and PB21 are positive (+), and the polarities of the video signals written to the sub-pixels of the even-numbered pixel lines, for example, the sub-pixels PR12, PG12, PB12, PR22, PG22 and PB22 are negative (−). In one frame period subsequent to the frame period shown in the figure, the polarities of the video signals of the odd-numbered pixel lines are negative (−), and the polarities of the video signals of the even-numbered pixel lines are positive (+). In other words, the polarity distribution equivalent to that of the line-inversion drive scheme can be obtained in the present configuration.

The positive polarity of the video signal indicates that the potential of the video signal written to the pixel electrode PE is high with respect to the potential of the common electrode CE, and the negative polarity of the video signal indicates that the potential of the video signal written to the pixel electrode PE is low with respect to the potential of the common electrode CE.

Figure 6:
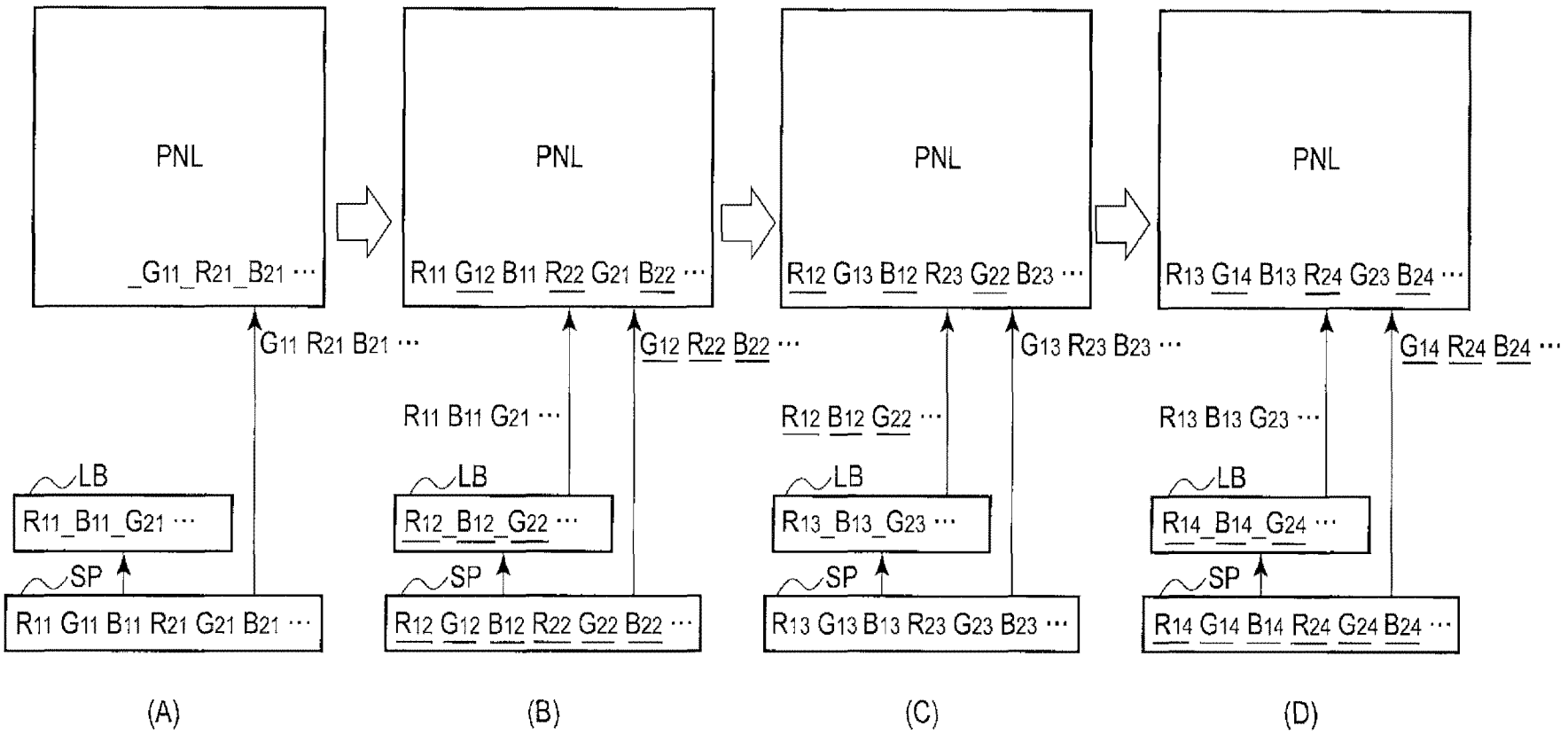
FIG. 6 is an illustration for explanation of an example of a method of writing the video signals to the liquid crystal display panel PNL of the pixel layout shown in FIG. 5.

FIG. 6 is an illustration for explanation of an example of a method of writing the video signals to the liquid crystal display panel PNL of the pixel layout shown in FIG. 5.

In the figure, Rn, Gn and Bn represent the video signals written to the pixel electrodes of the sub-pixels PRn, PGn and PBn, respectively, and indicate that the polarities of underlined video signals are different from those of non-underlined video signals. For example, the non-underlined video signals are assumed to have positive polarities and the underlined video signals are assumed to have negative polarities. In the present example, n is a positive integer.

In the figure, (A) indicates setting the switching element connected to the scanning line G1 to be conductive and writing the video signals via the switching element (i.e., a horizontal scanning period in which the scanning line G1 is selected). In other words, the signal processor SP produces the video signals (R11, G11, B11, R21, G21, B21, . . . ) for the first pixel line shown in FIG. 5, outputs the video signals (R11, B11, G21, . . . ) to the line buffer LB and outputs the video signals (G11, R21, B21, . . . ) to the liquid crystal display panel PNL. The video signals are thereby written to the sub-pixels PG11, PR21 and PB21, respectively. The line buffer LB temporarily stores the video signals (R11, B11, G21, . . . ).

In the figure, (B) indicates setting the switching element connected to the scanning line G2 to be conductive and writing the video signals via the switching element (i.e., a horizontal scanning period in which the scanning line G2 is selected). In other words, the signal processor SP produces the video signals (R12, G12, B12, R22, G22, B22, . . . ) for the second pixel line shown in FIG. 5, outputs the video signals (R12, B12, G22, . . . ) to the line buffer LB and outputs the video signals (G12, R22, B22, . . . ) to the liquid crystal display panel PNL. The line buffer LB temporarily stores the video signals (R12, B12, G22, . . . ) from the signal processor SP after outputting the stored video signals (R11, B11, G21, . . . ) to the liquid crystal display panel PNL. The video signals are thereby written to the sub-pixels PR11, PG12, PB11, PR22, PG21 and PB22, respectively.

In the figure, (C) indicates setting the switching element connected to the scanning line G3 to be conductive and writing the video signals via the switching element (i.e., a horizontal scanning period in which the scanning line G3 is selected). In other words, the signal processor SP produces the video signals (R13, G13, B13, R23, G23, B23, . . . ) for the third pixel line shown in FIG. 5, outputs the video signals (R13, B13, G23, . . . ) to the line buffer LB and outputs the video signals (G13, R23, B23, . . . ) to the liquid crystal display panel PNL. The line buffer LB temporarily stores the video signals (R13, B13, G23, . . . ) from the signal processor SP after outputting the stored video signals (R12, B12, G22, . . . ) to the liquid crystal display panel PNL. The video signals are thereby written to the sub-pixels PR12, PG13, PB12, PR23, PG22 and PB23, respectively.

In the figure, (D) indicates setting the switching element connected to the scanning line G4 to be conductive and writing the video signals via the switching element (i.e., a horizontal scanning period in which the scanning line G4 is selected). In other words, the signal processor SP produces the video signals (R14, G14, B14, R24, G24, B24, . . . ) for a fourth pixel line (not shown), outputs the video signals (R14, B14, G24, . . . ) to the line buffer LB and outputs the video signals (G14, R24, B24, . . . ) to the liquid crystal display panel PNL. The line buffer LB temporarily stores the video signals (R14, B14, G24, . . . ) from the signal processor SP after outputting the stored video signals (R13, B13, G23, . . . ) to the liquid crystal display panel PNL. The video signals are thereby written to the sub-pixels PR13, PG14, PB13, PR24, PG23 and PB24, respectively.

Figure 7:
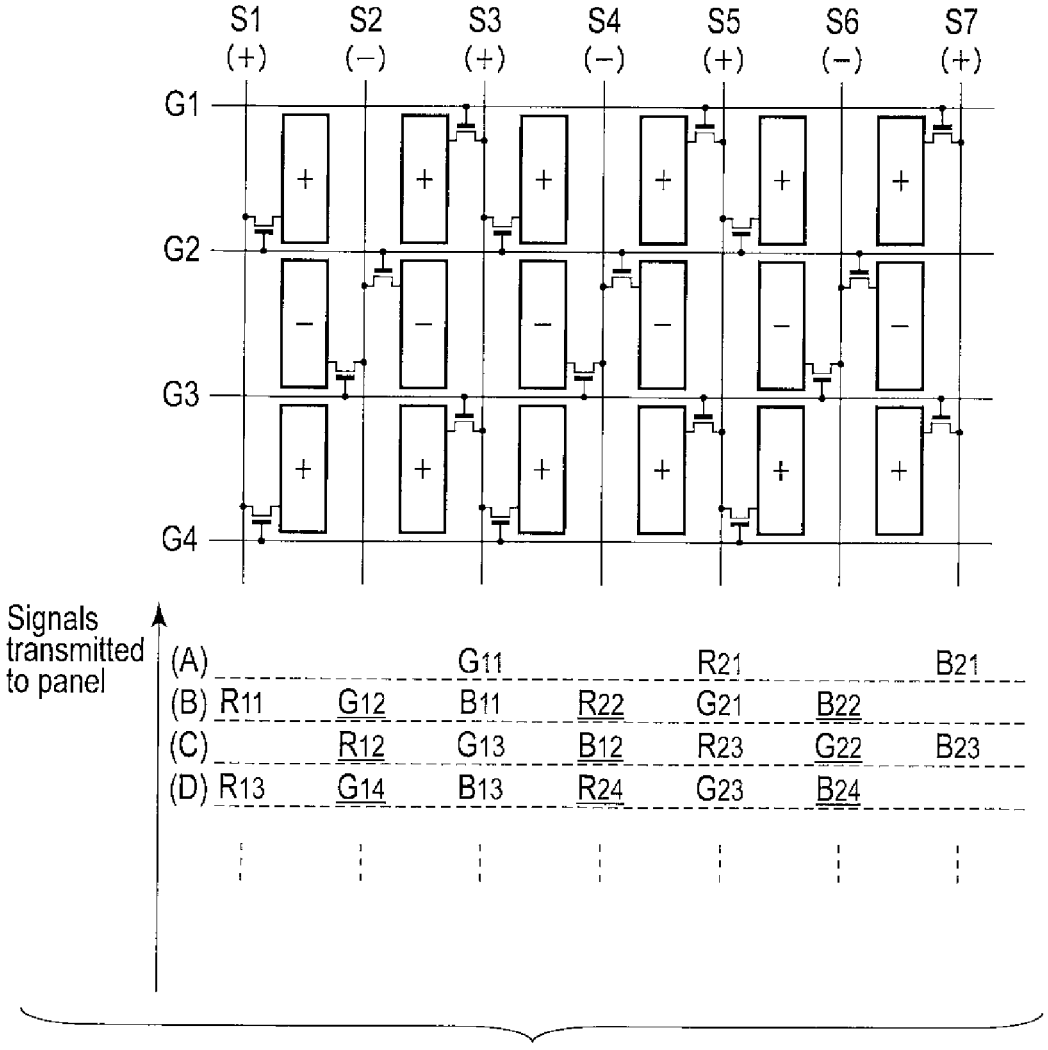
FIG. 7 is an illustration showing the polarities of the video signals output to the respective signal lines by the writing method explained with reference to FIG. 6.

FIG. 7 is an illustration showing the polarities of the video signals output to the respective signal lines by the writing method explained with reference to FIG. 6.

In the horizontal scanning period (A) in which the scanning line G1 is selected, the video signal G11 is output to the signal line S3, the video signal R21 is output to the signal line S5, and the video signal B21 is output to the signal line S7.

In the horizontal scanning period (B) in which the scanning line G2 is selected, the video signal R11 is output to the signal line S1, the video signal G12 is output to the signal line S2, the video signal B11 is output to the signal line S3, the video signal R22 is output to the signal line S4, the video signal G21 is output to the signal line S5, and the video signal B22 is output to the signal line S6.

In the horizontal scanning period (C) in which the scanning line G3 is selected, the video signal R12 is output to the signal line S2, the video signal G13 is output to the signal line S3, the video signal B12 is output to the signal line S4, the video signal R23 is output to the signal line S5, the video signal G22 is output to the signal line S6, and the video signal B23 is output to the signal line S7.

In the horizontal scanning period (D) in which the scanning line G4 is selected, the video signal R13 is output to the signal line S1, the video signal G14 is output to the signal line S2, the video signal B13 is output to the signal line S3, the video signal R24 is output to the signal line S4, the video signal G23 is output to the signal line S5, and the video signal B24 is output to the signal line S6.

When the polarities of the video signals output to the signal lines S1, S3, S5, and S7 are noticed, all the polarities are the same and positive (+) in one frame period, in the example illustrated. When the polarities of the video signals output to the signal lines S2, S4, and S6 are noticed, all the polarities are the same and negative (−) in one frame period, in the example illustrated.

Figure 8:
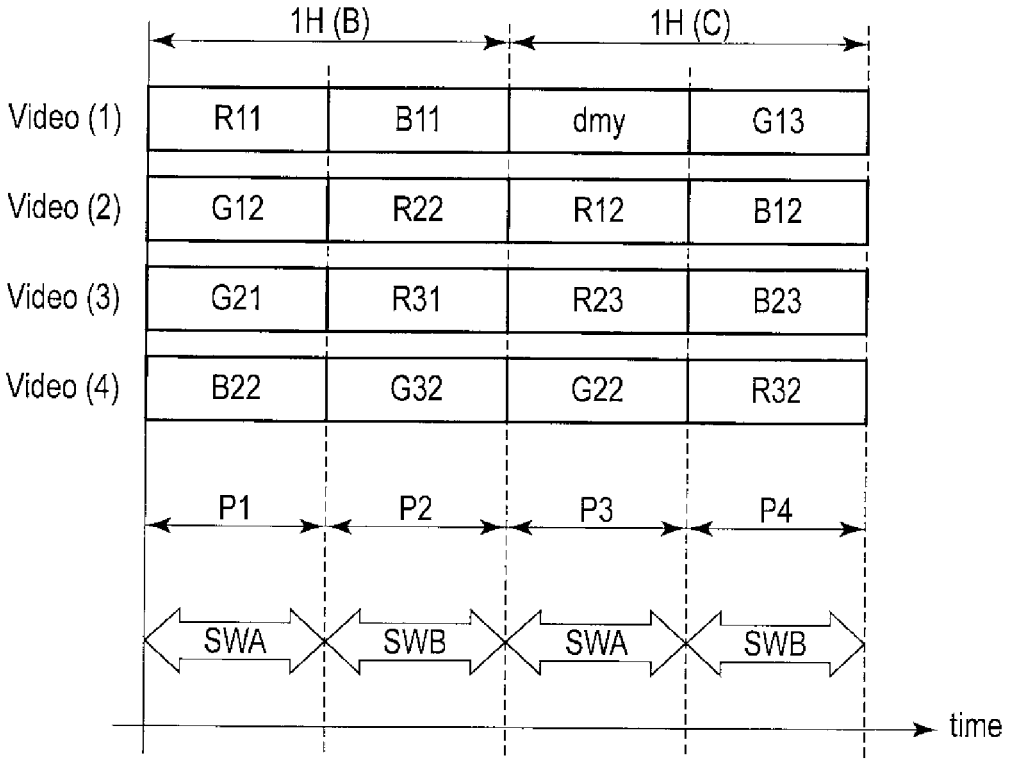
FIG. 8 is an illustration showing an example of timing of writing the video signals to the respective sub-pixels of the pixel layout shown in FIG. 5.

FIG. 8 is an illustration showing an example of timing of writing the video signals to the respective sub-pixels of the pixel layout shown in FIG. 5.

The horizontal scanning period 1H(B) in which the scanning line G2 is selected includes a first period P1 and a second period P2 subsequent to the first period P1. The horizontal scanning period 1H(C) in which the scanning line G3 is selected includes a third period P3 and a fourth period P4 subsequent to the third period P3. The first period P1 and the third period P3 are periods in which the switch SWA is conductive and the switch SWB is non-conductive. The second period P2 and the fourth period P4 are periods in which the switch SWB is conductive and the switch SWA is non-conductive.

In the first period P1, the output terminal Video (1) is electrically connected with the signal line S1, the output terminal Video (2) is electrically connected with the signal line S2, the output terminal Video (3) is electrically connected with the signal line S5, and the output terminal Video (4) is electrically connected with the signal line S6. The video signal R11 output from the output terminal Video (1) is written to the sub-pixel PR11 via the signal line S1. The video signal G12 output from the output terminal Video (2) is written to the sub-pixel PG12 via the signal line S2. The video signal G21 output from the output terminal Video (3) is written to the sub-pixel PG21 via the signal line S5. The video signal B22 output from the output terminal Video (4) is written to the sub-pixel PB22 via the signal line S6.

In the second period P2, the output terminal Video (1) is electrically connected with the signal line S3, the output terminal Video (2) is electrically connected with the signal line S4, the output terminal Video (3) is electrically connected with the signal line S7, and the output terminal Video (4) is electrically connected with the signal line S8. The video signal B11 output from the output terminal Video (1) is written to the sub-pixel PB11 via the signal line S3. The video signal R22 output from the output terminal Video (2) is written to the sub-pixel PR22 via the signal line S4. The video signal R31 output from the output terminal Video (3) is written to the sub-pixel PR31 via the signal line S7. The video signal G32 output from the output terminal Video (4) is written to the sub-pixel PG32 via the signal line S8.

In the third period P3, similarly to the first period P1, the output terminal Video (1) is electrically connected with the signal line S1, the output terminal Video (2) is electrically connected with the signal line S2, the output terminal Video (3) is electrically connected with the signal line S5, and the output terminal Video (4) is electrically connected with the signal line S6. A dummy video signal dmy output from the output terminal Video (1) is output to the signal line S1. The video signal R12 output from the output terminal Video (2) is written to the sub-pixel PR12 via the signal line S2. The video signal R23 output from the output terminal Video (3) is written to the sub-pixel PR23 via the signal line S5. The video signal G22 output from the output terminal Video (4) is written to the sub-pixel PG22 via the signal line S6.

In the fourth period P4, similarly to the second period P2, the output terminal Video (1) is electrically connected with the signal line S3, the output terminal Video (2) is electrically connected with the signal line S4, the output terminal Video (3) is electrically connected with the signal line S7, and the output terminal Video (4) is electrically connected with the signal line S8. The video signal G13 output from the output terminal Video (1) is written to the sub-pixel PG13 via the signal line S3. The video signal B12 output from the output terminal Video (2) is written to the sub-pixel PB12 via the signal line S4. The video signal B23 output from the output terminal Video (3) is written to the sub-pixel PB23 via the signal line S7. The video signal R32 output from the output terminal Video (4) is written to the sub-pixel PR32 via the signal line S8.

When the main pixel PX12 is noticed, the video signal is written to the sub-pixel PR12 in the third period P3, the video signal is written to the sub-pixel PG12 in the first period P1, and the video signal is written to the sub-pixel PB12 in the fourth period P4. When the main pixel PX22 is noticed, the video signal is written to the sub-pixel PR22 in the second period P2, the video signal is written to the sub-pixel PG22 in the third period P3, and the video signal is written to the sub-pixel PB22 in the first period P1. In other words, the horizontal scanning periods for at least two pixel lines are required to write the video signals to all the sub-pixels constituting each main pixel.

According to the present embodiment, the polarities of the video signals output to the respective signal lines are not varied in one frame period, and the polarities of the video signals of the signal lines adjacent in the first direction X are opposite to each other. In other words, the column-inversion drive scheme is applied to the present embodiment. For this reason, the energy consumption can be reduced in comparison with the use of the line-inversion drive scheme of supplying the video images having the polarities inverted in each one or more pixel lines for the same signal line. In addition, since the polarities of the sub-pixels adjacent in the first direction X become the same under conditions under which the optical properties such as the reflectivity and the contrast ratio are optimized, an undesired lateral electric field between the adjacent sub-pixels can be suppressed and the disclination can also be suppressed. Thus, the display quality can be improved and the energy consumption can be reduced.

In the above-explained example, two signal lines are connected to one output terminal Video via the switches, and one horizontal scanning period is divided into two periods to output the video signals to each signal line, but at least three signal lines may be connected to one output terminal Video via the switches and, in this case, one horizontal scanning period may be divided into a necessary number of periods to output the video signals to each signal line.

Next, another configuration example of the present embodiment will be explained.

Figure 9:
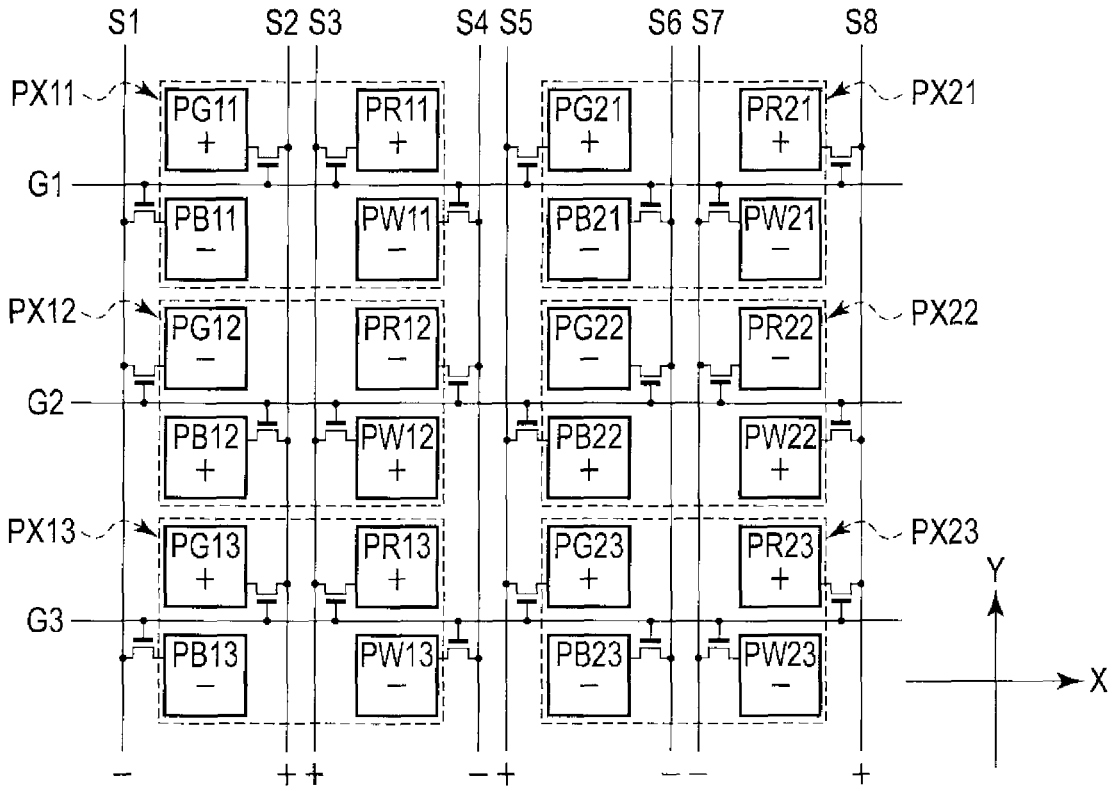
FIG. 9 is an illustration schematically showing a relationship between another pixel layout in the display area, and polarities of the video signals written to the respective pixels.

FIG. 9 is an illustration schematically showing a relationship between another pixel layout in the display area, and the polarities of the video signals written to the respective pixels.

Some main pixels in the display area are shown in the pixel layout shown in the figure, the main pixels PX11 to 13 and PX21 to PX23 are arranged in the second direction Y, and the main pixels PX11 and PX21, the main pixels PX12 and PX22, and the main pixels PX13 and PX23 are arranged in the first direction X. When the main pixel PX11 is noticed, the main pixel PX11 includes sub-pixels PR11, PG11, PB11, and PW11. Each of the other main pixels similarly includes four sub-pixels. In the figure, PRn, PGn, PBn and PWn indicate a red sub-pixel, a green sub-pixel, a blue sub-pixel and a sub-pixel of a fourth color (for example, white), respectively, in each main pixel PXn, and n indicates a positive integer. The other configuration examples to be explained below are the same as this with respect to this point.

In the example illustrated, the sub-pixels PG11, PR11, PG21 and PR21 are arranged in the first direction X. The sub-pixels PB11, PW11, PB21 and PW21 are arranged in the first direction X. The sub-pixels PG12, PR12, PG22 and PR22 are arranged in the first direction X. The sub-pixels PB12, PW12, PB22 and PW22 are arranged in the first direction X. The sub-pixels PG11, PB11, PG12 and PB12 are located between the signal lines S1 and S2, and arranged in the second direction Y. The sub-pixels PR11, PW11, PR12 and PW12 are located between the signal lines S3 and S4, and arranged in the second direction Y. The sub-pixels PG21, PB21, PG22 and PB22 are located between the signal lines S5 and S6, and arranged in the second direction Y. The sub-pixels PR21, PW21, PR22 and PW22 are located between the signal lines S7 and S8, and arranged in the second direction Y. The scanning line G1 is located between the sub-pixels PG11 and PB11, between the sub-pixels PR11 and PW11, between the sub-pixels PG21 and PB21, and between the sub-pixels PR21 and PW21. The scanning line G2 is located between the sub-pixels PG12 and PB12, between the sub-pixels PR12 and PW12, between the sub-pixels PG22 and PB22, and between the sub-pixels PR22 and PW22. The sub-pixels shown in the figure are in the form of, for example, squares of the same size, but some of the sub-pixels may be formed to be larger or smaller than the other sub-pixels.

In the main pixel PX11, the switching element of the sub-pixel PR11 is electrically connected with the scanning line G1, the signal line S3 and the pixel electrode. Hereinafter, this connection state will simply be explained similarly to a phrase "the sub-pixel PR11 is electrically connected with the scanning line G1 and the signal line S3". The sub-pixel PG11 is electrically connected with the scanning line G1 and the signal line S2. The sub-pixel PB11 is electrically connected with the scanning line G1 and the signal line S1. The sub-pixel PW11 is electrically connected with the scanning line G1 and the signal line S4.

In the main pixel PX21, the sub-pixel PR21 is electrically connected with the scanning line G1 and the signal line S8. The sub-pixel PG21 is electrically connected with the scanning line G1 and the signal line S5. The sub-pixel PB21 is electrically connected with the scanning line G1 and the signal line S6. The sub-pixel PW21 is electrically connected with the scanning line G1 and the signal line S7.

In the main pixel PX12, the sub-pixel PR12 is electrically connected with the scanning line G2 and the signal line S4. The sub-pixel PG12 is electrically connected with the scanning line G2 and the signal line S1. The sub-pixel PB12 is electrically connected with the scanning line G2 and the signal line S2. The sub-pixel PW12 is electrically connected with the scanning line G2 and the signal line S3.

In the main pixel PX22, the sub-pixel PR22 is electrically connected with the scanning line G2 and the signal line S7. The sub-pixel PG22 is electrically connected with the scanning line G2 and the signal line S6. The sub-pixel PB22 is electrically connected with the scanning line G2 and the signal line S5. The sub-pixel PW22 is electrically connected with the scanning line G2 and the signal line S8.

Of the pixel lines composed of the sub-pixels arranged in the first direction X, the first pixel line is constituted similarly to the fifth pixel line, and the second pixel line is constituted similarly to the sixth pixel line. That is, the m-th pixel line is constituted similarly to the (m+4)-th pixel line. In other words, in the main pixels arranged in the second direction Y, the odd-numbered main pixels are constituted similarly to each other, and the even-numbered main pixels are constituted similarly to each other.

In one frame period, negative-polarity video signals (−) are supplied to the signal lines S1, S4, S6 and S7, and positive-polarity video signals (+) are supplied to the signal lines S2, S3, S5 and S8.

In the horizontal scanning period in which the scanning line G1 is selected, the video signal (−) is written to the sub-pixel PB11 via the signal line S1, the video signal (+) is written to the sub-pixel PG11 via the signal line S2, the video signal (+) is written to the sub-pixel PR11 via the signal line S3, the video signal (−) is written to the sub-pixel PW11 via the signal line S4, the video signal (+) is output to the sub-pixel PG21 via the signal line S5, the video signal (−) is written to the sub-pixel PB21 via the signal line S6, the video signal (−) is written to the sub-pixel PW21 via the signal line S7, and the video signal (+) is written to the sub-pixel PR21 via the signal line S8. It should be noted that in the horizontal scanning period in which the scanning line G3 is selected, the video signal is written to the scanning line G3, similarly to the horizontal scanning period in which the scanning line G1 is selected.

In the horizontal scanning period in which the scanning line G2 is selected, the video signal (−) is written to the sub-pixel PG12 via the signal line S1, the video signal (+) is written to the sub-pixel PB12 via the signal line S2, the video signal (+) is written to the sub-pixel PW12 via the signal line S3, the video signal (−) is written to the sub-pixel PR12 via the signal line S4, the video signal (+) is output to the sub-pixel PB22 via the signal line S5, the video signal (−) is written to the sub-pixel PG22 via the signal line S6, the video signal (−) is written to the sub-pixel PR22 via the signal line S7, and the video signal (+) is written to the sub-pixel PW22 via the signal line S8.

In this configuration example, too, the polarity of the video signal output to each of the signal lines is not varied, and the column-inversion drive scheme is applied to the configuration. In addition, the disclination can be suppressed since the polarities of the pixels adjacent in the first direction X are the same as each other. Thus, the display quality can be improved and the energy consumption can be reduced. Moreover, in this configuration example, since the video signals can be written from the respective signal lines to the corresponding sub-pixels, in each horizontal scanning period, the video signals do not need to be rearranged and the line buffer is unnecessary.

Figure 10:
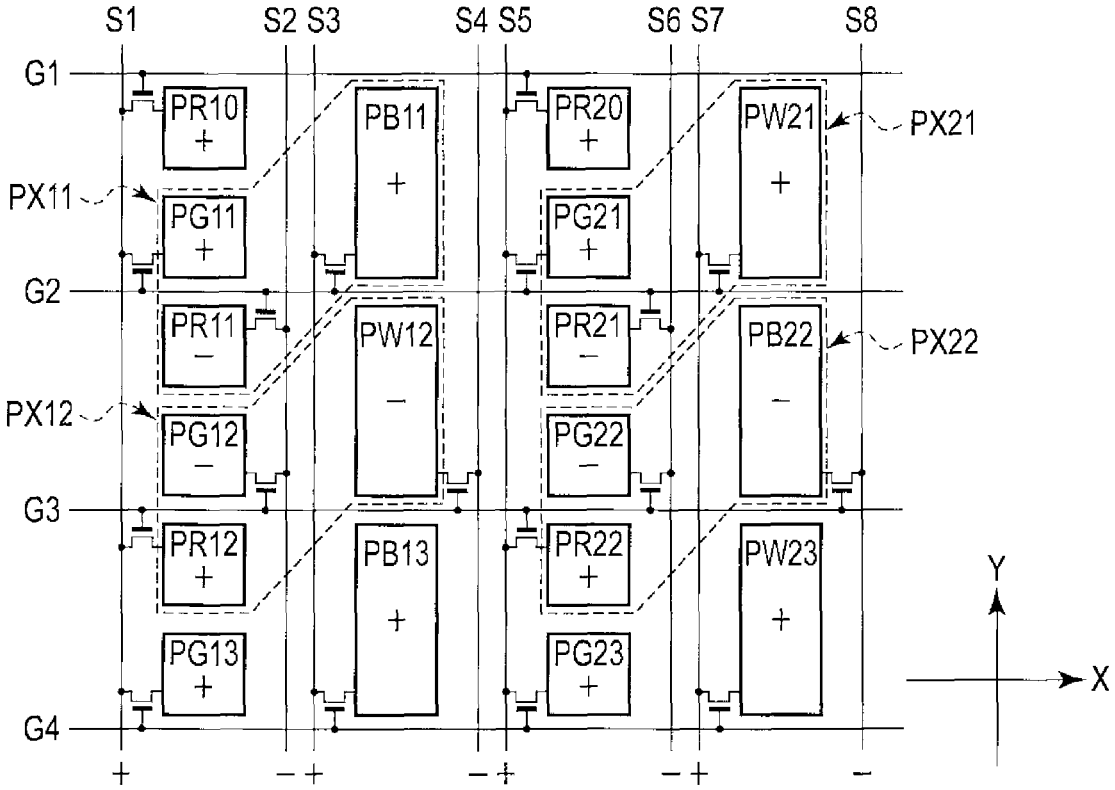
FIG. 10 is an illustration schematically showing a relationship between yet another pixel layout in the display area, and polarities of the video signals written to the respective pixels.

FIG. 10 is an illustration schematically showing a relationship between yet another pixel layout in the display area, and the polarities of the video signals written to the respective pixels.

The layout of the main pixels PX11, PX12, PX21 and PX22 is the same as that shown in the figure. The main pixel PX11 includes the sub-pixels PR11, PG11 and PB11. The main pixel PX21 includes the sub-pixels PR21, PG21 and PW21. The main pixel PX12 includes the sub-pixels PR12, PG12 and PW12. The main pixel PX22 includes the sub-pixels PR22, PG22 and PB22.

In the example illustrated, the sub-pixels PR10, PG11, PB11, PR20, PG21 and PW21 are located between the scanning lines G1 and G2. The sub-pixels PR11, PG12, PW12, PR21, PG22 and PB22 are located between the scanning lines G2 and G3. The sub-pixels PR12, PG13, PB13, PR22, PG23 and PW23 are located between the scanning lines G3 and G4. The sub-pixels PR10, PG11, PR11, PG12, PR12 and PG13 are located between the signal lines S1 and S2, and arranged in the second direction Y. The sub-pixels PB11, PW12 and PB13 are located between the signal lines S3 and S4, and arranged in the second direction Y. The sub-pixels PR20, PG21, PR21, PG22, PR22 and PG23 are located between the signal lines S5 and S6, and arranged in the second direction Y. The sub-pixels PW21, PB22 and PW23 are located between the signal lines S7 and S8, and arranged in the second direction Y.

The sub-pixel PB11 is arranged in the first direction X together with the sub-pixels PR10 and PG11. The sub-pixel PW12 is arranged in the first direction X together with the sub-pixels PR11 and PG12. The sub-pixel PB13 is arranged in the first direction X together with the sub-pixels PR12 and PG13. When the main pixel PX11 is noticed, the sub-pixels PG11 and PB11 are arranged in the first direction X so as to sandwich the signal lines S2 and S3, and the sub-pixels PG11 and PR11 are arranged in the second direction Y so as to sandwich the scanning line G2. When the main pixel PX12 is noticed, the sub-pixels PG12 and PW12 are arranged in the first direction X so as to sandwich the signal lines S2 and S3, and the sub-pixels PG12 and PR12 are arranged in the second direction Y so as to sandwich the scanning line G3. The sub-pixels PB11 and PW12 are arranged in the first direction X so as to sandwich the scanning line G2.

Of the sub-pixels shown in the figure, the sub-pixels arranged in the second direction Y are formed in the same size. The sub-pixels adjacent in the first direction X are different in size from each other. For example, the sub-pixel PB11 is formed to be larger than the sub-pixel PG11, for example, approximately twice as large as the sub-pixel PG11. Similarly, the sub-pixel PW12 is formed to be larger than the sub-pixel PG12, for example, approximately twice as large as the sub-pixel PG12. Each of the sub-pixels PG11 and PR11 arranged in the second direction Y is in the shape of, for example, a square, and the sub-pixel PB11 is in a longitudinally elongated shape (rectangular shape) extending in the second direction Y.

In the main pixel PX11, the sub-pixel PR11 is electrically connected with the scanning line G2 and the signal line S2. The sub-pixel PG11 is electrically connected with the scanning line G2 and the signal line S1. The sub-pixel PB11 is electrically connected with the scanning line G2 and the signal line S3.

In the main pixel PX21, the sub-pixel PR21 is electrically connected with the scanning line G2 and the signal line S6. The sub-pixel PG21 is electrically connected with the scanning line G2 and the signal line S5. The sub-pixel PW21 is electrically connected with the scanning line G2 and the signal line S7.

In the main pixel PX12, the sub-pixel PR12 is electrically connected with the scanning line G3 and the signal line S1. The sub-pixel PG12 is electrically connected with the scanning line G3 and the signal line S2. The sub-pixel PW12 is electrically connected with the scanning line G3 and the signal line S4.

In the main pixel PX22, the sub-pixel PR22 is electrically connected with the scanning line G3 and the signal line S5. The sub-pixel PG22 is electrically connected with the scanning line G3 and the signal line S6. The sub-pixel PB22 is electrically connected with the scanning line G3 and the signal line S8.

In one frame period, positive-polarity video signals (+) are supplied to the signal lines S1, S3, S5 and S7, and negative-polarity video signals (−) are supplied to the signal lines S2, S4, S6 and S8.

In the horizontal scanning period in which the scanning line G1 is selected, the video signal (+) is written to the sub-pixel PR10 via the signal line S1 and the video signal (+) is written to the sub-pixel PR20 via the signal line S5, of the video signals which should be written to the sub-pixels PR10, PG11, PB11, PR20, PG21 and PW21. It should be noted that in this horizontal scanning period, the sub-pixels which should be written to the sub-pixels PG11, PB11, PG21 and PW21 are temporarily stored in the line buffer.

In the horizontal scanning period in which the scanning line G2 is selected, the video signal (−) is written to the sub-pixel PR11 via the signal line S2 and the video signal (−) is written to the sub-pixel PR21 via the signal line S6, of the video signals which should be written to the sub-pixels PR11, PG12, PW12, PR21, PG22 and PB22. It should be noted that in this horizontal scanning period, the sub-pixels which should be written to the sub-pixels PG11, PB11, PG21 and PW21 are output to the respective signal lines while the sub-pixels which should be written to the sub-pixels PG12, PW12, PG22 and PB22 are temporarily stored in the line buffer. At this time, the video signal (+) is written to the sub-pixel PG11 via the signal line S1, the video signal (+) is written to the sub-pixel PB11 via the signal line S3, the video signal (+) is written to the sub-pixel PG21 via the signal line S5, and the video signal (+) is written to the sub-pixel PW21 via the signal line S7.

In this configuration example, too, the same advantages as those of the above-explained configuration examples can be obtained. It should be noted that to write the video signals to the respective sub-pixels in the main pixels PX11 and PX21, some video signals need to be temporarily stored and rearranged in the first horizontal scanning period and the line buffer is required.

Figure 11:
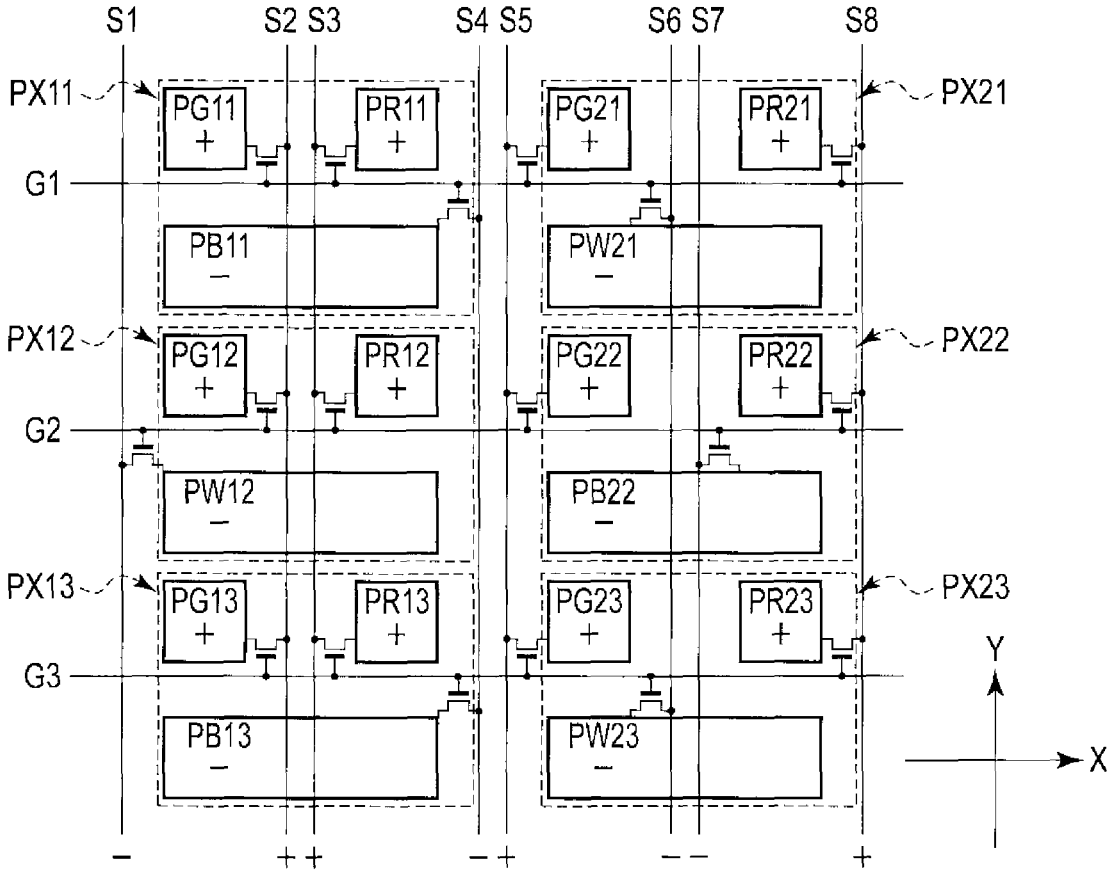
FIG. 11 is an illustration schematically showing a relationship between yet another pixel layout in the display area, and the polarities of the video signals written to the respective pixels.

FIG. 11 is an illustration schematically showing a relationship between yet another pixel layout in the display area, and the polarities of the video signals written to the respective pixels.

The layout of the main pixels PX11 to PX13 and PX21 to PX23 is the same as that shown in the figure. The main pixel PX11 includes the sub-pixels PR11, PG11 and PB11. The main pixel PX21 includes the sub-pixels PR21, PG21 and PW21. The main pixel PX12 includes the sub-pixels PR12, PG12 and PW12. The main pixel PR22 includes the sub-pixels PR22, PG22 and PB22. The main pixel PX13 includes the sub-pixels PR13, PG13 and PB13. The main pixel PX23 includes the sub-pixels PR23, PG23 and PW23.

In the example illustrated, the sub-pixels PG11, PR11, PG21 and PR21 are arranged in the first direction X. The sub-pixels PB11 and PW21 are arranged in the first direction X. The sub-pixels PG12, PR12, PG22 and PR22 are arranged in the first direction X. The sub-pixels PW12 and PB22 are arranged in the first direction X. The sub-pixels PG11 and PG12 are located between the signal lines S1 and S2, and arranged in the second direction Y so as to sandwich the sub-pixel PB11. The sub-pixels PR11 and PR12 are located between the signal lines S3 and S4, and arranged in the second direction Y so as to sandwich the sub-pixel PB11. The sub-pixels PG21 and PG22 are located between the signal lines S5 and S6, and arranged in the second direction Y so as to sandwich the sub-pixel PW21. The sub-pixels PR21 and PR22 are located between the signal lines S7 and S8, and arranged in the second direction Y so as to sandwich the sub-pixel PW21. The sub-pixel PB11, and the sub-pixels PG11 and PR11 are arranged in the second direction so as to sandwich the scanning line G1. The sub-pixel PW21, and the sub-pixels PG21 and PR21 are arranged in the second direction so as to sandwich the scanning line G1. The sub-pixel PW12, and the sub-pixels PG12 and PR12 are arranged in the second direction so as to sandwich the scanning line G2. The sub-pixel PB22, and the sub-pixels PG22 and PR22 are arranged in the second direction so as to sandwich the scanning line G2.

Of the sub-pixels shown in the figure, the sub-pixels arranged in the first direction X are formed in the same size. The sub-pixels adjacent in the second direction Y are different in size from each other. For example, the sub-pixel PB11 is formed to be larger than the sub-pixel PG11, for example, approximately twice as large as the sub-pixel PG11. Similarly, the sub-pixel PW12 is formed to be larger than the sub-pixel PG12, for example, approximately twice as large as the sub-pixel PG12. Each of the sub-pixels PG11 and PR11 arranged in the first direction X is shaped in, for example, a square and the sub-pixel PB11 is in a laterally elongated shape (rectangular shape) extending in the first direction X.

In the main pixel PX11, the sub-pixel PR11 is electrically connected with the scanning line G1 and the signal line S3. The sub-pixel PG11 is electrically connected with the scanning line G1 and the signal line S2. The sub-pixel PB11 is electrically connected with the scanning line G1 and the signal line S4.

In the main pixel PX21, the sub-pixel PR21 is electrically connected with the scanning line G1 and the signal line S8. The sub-pixel PG21 is electrically connected with the scanning line G1 and the signal line S5. The sub-pixel PW21 is electrically connected with the scanning line G1 and the signal line S6.

In the main pixel PX12, the sub-pixel PR12 is electrically connected with the scanning line G2 and the signal line S3. The sub-pixel PG12 is electrically connected with the scanning line G2 and the signal line S2. The sub-pixel PW12 is electrically connected with the scanning line G2 and the signal line S1.

In the main pixel PX22, the sub-pixel PR22 is electrically connected with the scanning line G2 and the signal line S8. The sub-pixel PG22 is electrically connected with the scanning line G2 and the signal line S5. The sub-pixel PB22 is electrically connected with the scanning line G2 and the signal line S7.

In one frame period, negative-polarity video signals (−) are supplied to the signal lines S1, S4, S6 and S7, and positive-polarity video signals (+) are supplied to the signal lines S2, S3, S5 and S8.

In the horizontal scanning period in which the scanning line G1 is selected, the video signal (+) is written to the sub-pixel PG11 via the signal line S2, the video signal (+) is written to the sub-pixel PR11 via the signal line S3, the video signal (−) is written to the sub-pixel PB11 via the signal line S4, the video signal (+) is output to the sub-pixel PG21 via the signal line S5, the video signal (−) is written to the sub-pixel PW21 via the signal line S6, and the video signal (+) is written to the sub-pixel PR21 via the signal line S8. It should be noted that in the horizontal scanning period in which the scanning line G3 is selected, the video signal is written to the scanning line S3, similarly to the horizontal scanning period in which the scanning line G1 is selected.

In the horizontal scanning period in which the scanning line G2 is selected, the video signal (−) is written to the sub-pixel PW12 via the signal line S1, the video signal (+) is written to the sub-pixel PG12 via the signal line S2, the video signal (+) is written to the sub-pixel PR12 via the signal line S3, the video signal (+) is output to the sub-pixel PG22 via the signal line S5, the video signal (−) is written to the sub-pixel PB22 via the signal line S7, and the video signal (+) is written to the sub-pixel PR22 via the signal line S8.

In this configuration example, too, the same advantages as those of the above-explained configuration examples can be obtained. Moreover, in this configuration example, the line buffer is unnecessary since the video signals can be written from the respective signal lines to the corresponding sub-pixels, in each horizontal scanning period.

Figure 12:
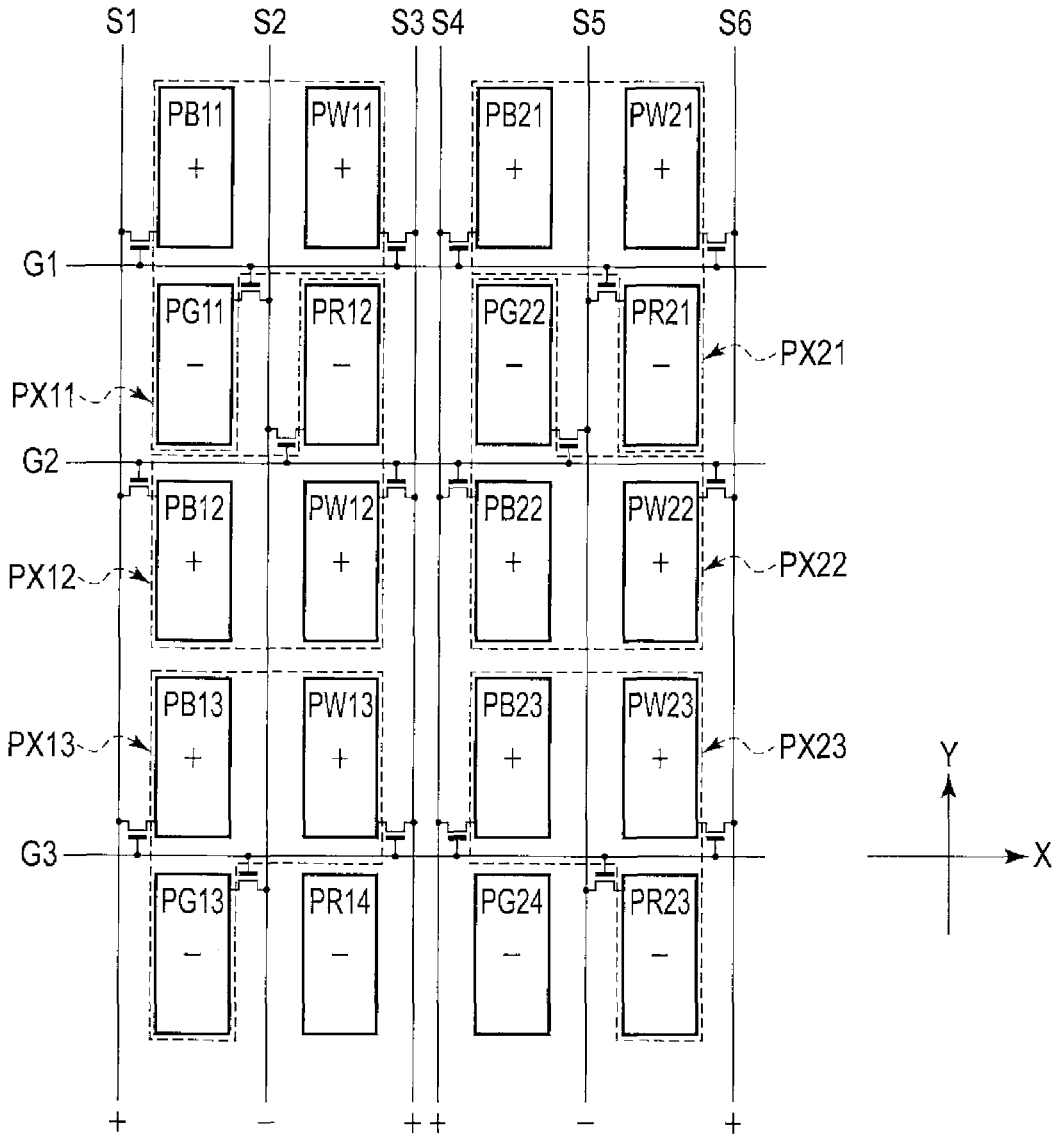
FIG. 12 is an illustration schematically showing a relationship between yet another pixel layout in the display area, and polarities of video signals written to respective pixels.

FIG. 12 is an illustration schematically showing a relationship between yet another pixel layout in the display area, and polarities of video signals written to respective pixels.

The layout of the main pixels PX11 to PX13 and PX21 to PX23 is the same as that shown in the figure. The main pixel PX11 includes the sub-pixels PB11, PG11 and PW11. The main pixel PX21 includes the sub-pixels PB21, PR21 and PW21. The main pixel PX12 includes the sub-pixels PB12, PR12 and PW12. The main pixel PX22 includes the sub-pixels PB22, PG22 and PW22. The main pixel PX13 includes the sub-pixels PB13, PG13 and PW13. The main pixel PX23 includes the sub-pixels PB23, PR23 and PW23.

In the example illustrated, the sub-pixels PB11, PW11, PB21 and PW21 are arranged in the first direction X. The sub-pixels PG11, PR12, PG22 and PR21 are arranged in the first direction X. The sub-pixels PB12, PW12, PB22 and PW22 are arranged in the first direction X. The sub-pixels PB11, PG11 and PB12 are located between the signal lines S1 and S2, and arranged in the second direction Y. The sub-pixels PW11, PR12 and PW12 are located between the signal lines S2 and S3, and arranged in the second direction Y. The sub-pixels PB21, PG22 and PB22 are located between the signal lines S4 and S5, and arranged in the second direction Y. The sub-pixels PW21, PR21 and PW22 are located between the signal lines S5 and S6, and arranged in the second direction Y. The scanning line G1 is located between the sub-pixels PB11 and PG11, between the sub-pixels PW11 and PR12, between the sub-pixels PB21 and PG22, and between the sub-pixels PW21 and PR21. The scanning line G2 is located between the sub-pixels PG11 and PB12, between the sub-pixels PR12 and PW12, between the sub-pixels PG22 and PB22, and between the sub-pixels PR21 and PW22. Each of the sub-pixels shown in the figure is in a longitudinally elongated shape (rectangular shape) extending in the second direction Y. In addition, the sub-pixels shown in the figure are formed in the same size, but some of the sub-pixels may be formed to be larger or smaller than the other sub-pixels.

Two main pixels arranged in the second direction Y function as a pair of unit pixels and share sub-pixels of colors removed from the respective main pixels. In other words, the sub-pixel of the color removed from either of the main pixels is included in the other main pixel. In the example illustrated, when the unit pixel composed of the main pixels PX11 and PX12 is noticed, a red sub-pixel is removed from the main pixel PX11 while the main pixel PX12 includes the sub-pixel PR12, and a green sub-pixel is removed from the main pixel PX12 while the main pixel PX11 includes the sub-pixel PG11. In other words, the green sub-pixel PG11 and the red sub-pixel PR12 are shared in the unit pixel composed of the main pixels PX11 and PX12.

Moreover, the sub-pixels PG11 and PR12 located between the scanning lines G1 and G2 are arranged in the first direction X.

In the main pixel PX11, the sub-pixel PB11 is electrically connected with the scanning line G1 and the signal line S1. The sub-pixel PG11 is electrically connected with the scanning line G1 and the signal line S2. The sub-pixel PW11 is electrically connected with the scanning line G1 and the signal line S3.

In the main pixel PX21, the sub-pixel PB21 is electrically connected with the scanning line G1 and the signal line S4. The sub-pixel PR21 is electrically connected with the scanning line G1 and the signal line S5. The sub-pixel PW21 is electrically connected with the scanning line G1 and the signal line S6.

In the main pixel PX12, the sub-pixel PB12 is electrically connected with the scanning line G2 and the signal line S1. The sub-pixel PR12 is electrically connected with the scanning line G2 and the signal line S2. The sub-pixel PW12 is electrically connected with the scanning line G2 and the signal line S3.

In the main pixel PX22, the sub-pixel PB22 is electrically connected with the scanning line G2 and the signal line S4. The sub-pixel PG22 is electrically connected with the scanning line G2 and the signal line S5. The sub-pixel PW22 is electrically connected with the scanning line G2 and the signal line S6.

In one frame period, positive-polarity video signals (+) are supplied to the signal lines S1, S3, S4 and S6, and negative-polarity video signals (−) are supplied to the signal lines S2 and S5.

In the horizontal scanning period in which the scanning line G1 is selected, the video signal (+) is written to the sub-pixel PB11 via the signal line S1, the video signal (−) is written to the sub-pixel PG11 via the signal line S2, the video signal (+) is written to the sub-pixel PW11 via the signal line S3, the video signal (+) is written to the sub-pixel PB21 via the signal line S4, the video signal (−) is output to the sub-pixel PR21 via the signal line S5, and the video signal (+) is written to the sub-pixel PW21 via the signal line S6. It should be noted that in the horizontal scanning period in which the scanning line G3 is selected, the video signal is written to the scanning line S3, similarly to the horizontal scanning period in which the scanning line G1 is selected.

In the horizontal scanning period in which the scanning line G2 is selected, the video signal (+) is written to the sub-pixel PB12 via the signal line S1, the video signal (−) is written to the sub-pixel PR12 via the signal line S2, the video signal (+) is written to the sub-pixel PW12 via the signal line S3, the video signal (+) is written to the sub-pixel PB22 via the signal line S4, the video signal (−) is output to the sub-pixel PG22 via the signal line S5, and the video signal (+) is written to the sub-pixel PW22 via the signal line S6.

It should be noted that processing of averaging the video signals is executed between the paired main pixels, in the removing configuration as shown in the figure. For example, the signal processor SP shown in FIG. 5 executes averaging based on the video signal G11 which should be written to the green sub-pixel PG11 in the main pixel PX11 and the video signal G12 which should be written to the green sub-pixel in the main pixel PX12 (but not included in the actual main pixel PX12), and produces a corrected video signal. As the method of producing the corrected video signal for the averaging, a method of calculating the signal as an arithmetic mean by multiplying the video signals G11 and G12 by a predetermined coefficient, a method of calculating the signal as a geometric mean of the video signals G11 and G12, and the like can be applied. The corrected video signal thus produced is supplied to the signal line S2 and written to the sub-pixel PG11 in the horizontal scanning period in which the scanning line G1 is selected. Similarly to this, the signal processor SP executes averaging based on the video signal R11 which should be written to the red sub-pixel in the main pixel PX11 (but not included in the actual main pixel PX11) and the video signal R12 which should be written to the red sub-pixel PR11 in the main pixel PX12, and writes the produced corrected video signal to the sub-pixel PR12.

In this configuration example, too, the same advantages as those of the above-explained configuration examples can be obtained. Moreover, in this configuration example, the line buffer is unnecessary since the video signals can be written from the respective signal lines to the corresponding sub-pixels, in each horizontal scanning period. In the reflective liquid crystal display panel PNL in which reflected light tends to be easily colored in yellow, undesirable coloring of the reflected light can be suppressed and white color chromaticity can be improved by applying a layout in which more blue sub-pixels than red and green sub-pixels are arrayed. In addition, the reflectivity per unit pixel can be increased by applying a layout in which more white sub-pixels are arranged.

Figure 13:
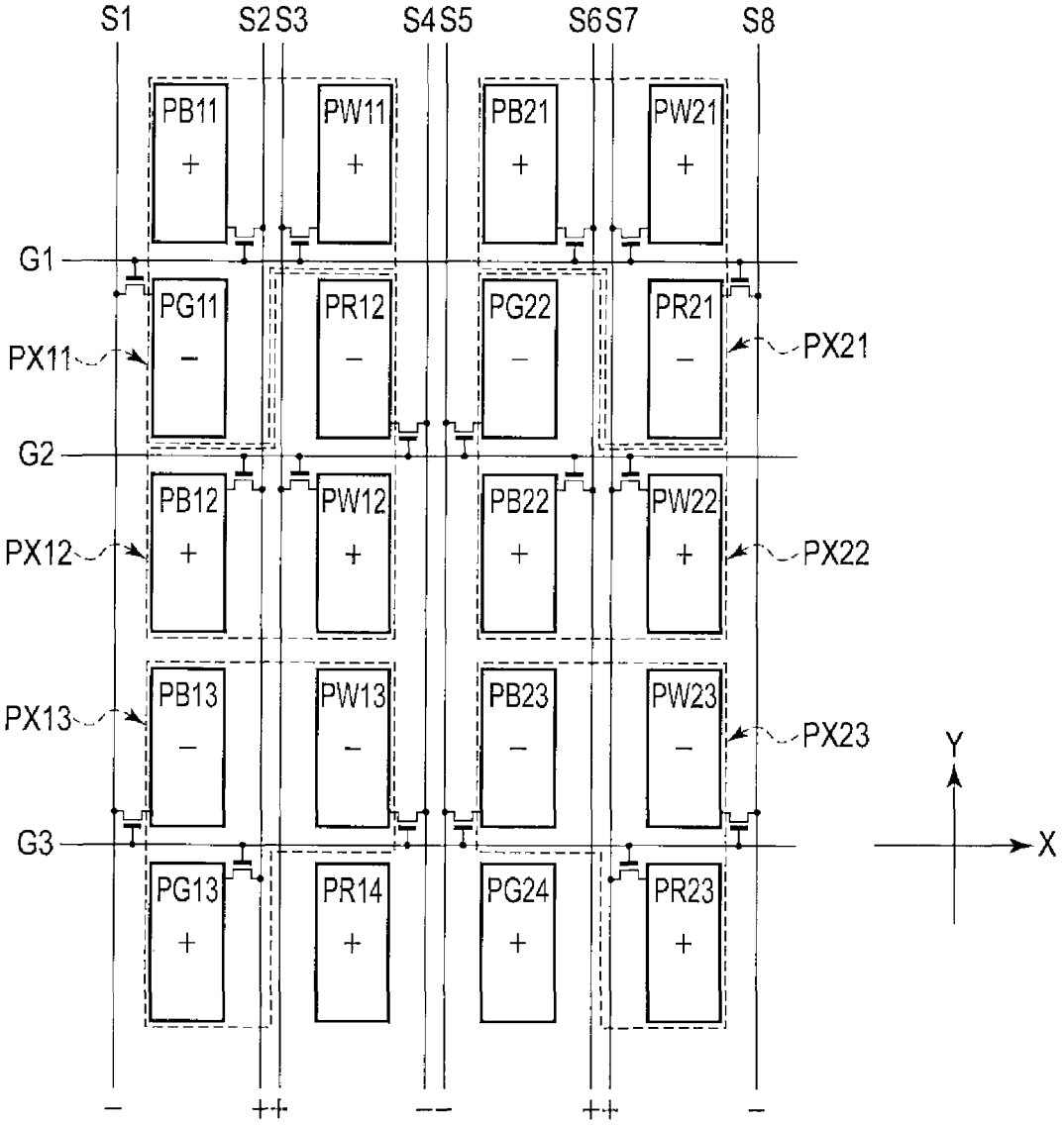
FIG. 13 is an illustration schematically showing a relationship between yet another pixel layout in the display area, and the polarities of the video signals written to the respective pixels.

FIG. 13 is an illustration schematically showing a relationship between yet another pixel layout in the display area, and the polarities of the video signals written to the respective pixels.

The example shown in FIG. 13 is different from the example shown in FIG. 12 with respect to the number of the signal lines and the connection between the sub-pixels and the signal lines, and is the same as the example shown in FIG. 12 with respect to the layout of the sub-pixels. The sub-pixels PB11, PG11 and PB12 are located between the signal lines S1 and S2, the sub-pixels PW11, PR12 and PW12 are located between the signal lines S3 and S4, the sub-pixels PB21, PG22 and PB22 are located between the signal lines S5 and S6, and the sub-pixels PW21, PR21 and PW22 are located between the signal lines S7 and S8.

In the main pixel PX11, the sub-pixel PG11 is electrically connected with the scanning line G1 and the signal line S1. The sub-pixel PB11 is electrically connected with the scanning line G1 and the signal line S2. The sub-pixel PW11 is electrically connected with the scanning line G1 and the signal line S3.

In the main pixel PX21, the sub-pixel PB21 is electrically connected with the scanning line G1 and the signal line S6. The sub-pixel PW21 is electrically connected with the scanning line G1 and the signal line S7. The sub-pixel PR21 is electrically connected with the scanning line G1 and the signal line S8.

In the main pixel PX12, the sub-pixel PB12 is electrically connected with the scanning line G2 and the signal line S2. The sub-pixel PW12 is electrically connected with the scanning line G2 and the signal line S3. The sub-pixel PR12 is electrically connected with the scanning line G2 and the signal line S4.

In the main pixel PX22, the sub-pixel PG22 is electrically connected with the scanning line G2 and the signal line S5. The sub-pixel PB22 is electrically connected with the scanning line G2 and the signal line S6. The sub-pixel PW22 is electrically connected with the scanning line G2 and the signal line S7.

In the main pixel PX13, the sub-pixel PB13 is electrically connected with the scanning line G1 and the signal line S1.

The sub-pixel PG13 is electrically connected with the scanning line G1 and the signal line S2. The sub-pixel PW13 is electrically connected with the scanning line G1 and the signal line S4.

In the main pixel PX23, the sub-pixel PB23 is electrically connected with the scanning line G1 and the signal line S5. The sub-pixel PR23 is electrically connected with the scanning line G1 and the signal line S7. The sub-pixel PW23 is electrically connected with the scanning line G1 and the signal line S8.

In one frame period, negative-polarity video signals (−) are supplied to the signal lines S1, S4, S5 and S8, and positive-polarity video signals (+) are supplied to the signal lines S2, S3, S6 and S7.

In the horizontal scanning period in which the scanning line G1 is selected, the video signal (−) is written to the sub-pixel PG11 via the signal line S1, the video signal (+) is written to the sub-pixel PB11 via the signal line S2, the video signal (+) is written to the sub-pixel PW11 via the signal line S3, the video signal (+) is output to the sub-pixel PB21 via the signal line S6, the video signal (+) is written to the sub-pixel PW21 via the signal line S7, and the video signal (−) is written to the sub-pixel PR21 via the signal line S8.

In the horizontal scanning period in which the scanning line G2 is selected, the video signal (+) is written to the sub-pixel PB12 via the signal line S2, the video signal (+) is written to the sub-pixel PW12 via the signal line S3, the video signal (−) is written to the sub-pixel PR12 via the signal line S4, the video signal (−) is output to the sub-pixel PG22 via the signal line S5, the video signal (+) is written to the sub-pixel PB22 via the signal line S6, and the video signal (+) is written to the sub-pixel PW22 via the signal line S7.

In the horizontal scanning period in which the scanning line G3 is selected, the video signal (−) is written to the sub-pixel PB13 via the signal line S1, the video signal (+) is written to the sub-pixel PG13 via the signal line S2, the video signal (−) is written to the sub-pixel PW13 via the signal line S4, the video signal (−) is output to the sub-pixel PB23 via the signal line S5, the video signal (+) is written to the sub-pixel PR23 via the signal line S7, and the video signal (−) is written to the sub-pixel PW23 via the signal line S8.

In this configuration example, too, the same advantages as those of the configuration example shown in FIG. 12 can be obtained. In the same frame period, the red sub-pixels (PR12 and PR14) are different in polarity from each other, the green sub-pixels (PG11 and PG13) are different in polarity from each other, the blue sub-pixels (PB11 and PB13) are different in polarity from each other, and the white sub-pixels (PW11 and PW13) are different in polarity from each other. For this reason, when monochromatic display of each of red, green, blue and white is executed, flicker can be reduced.

Figure 14:
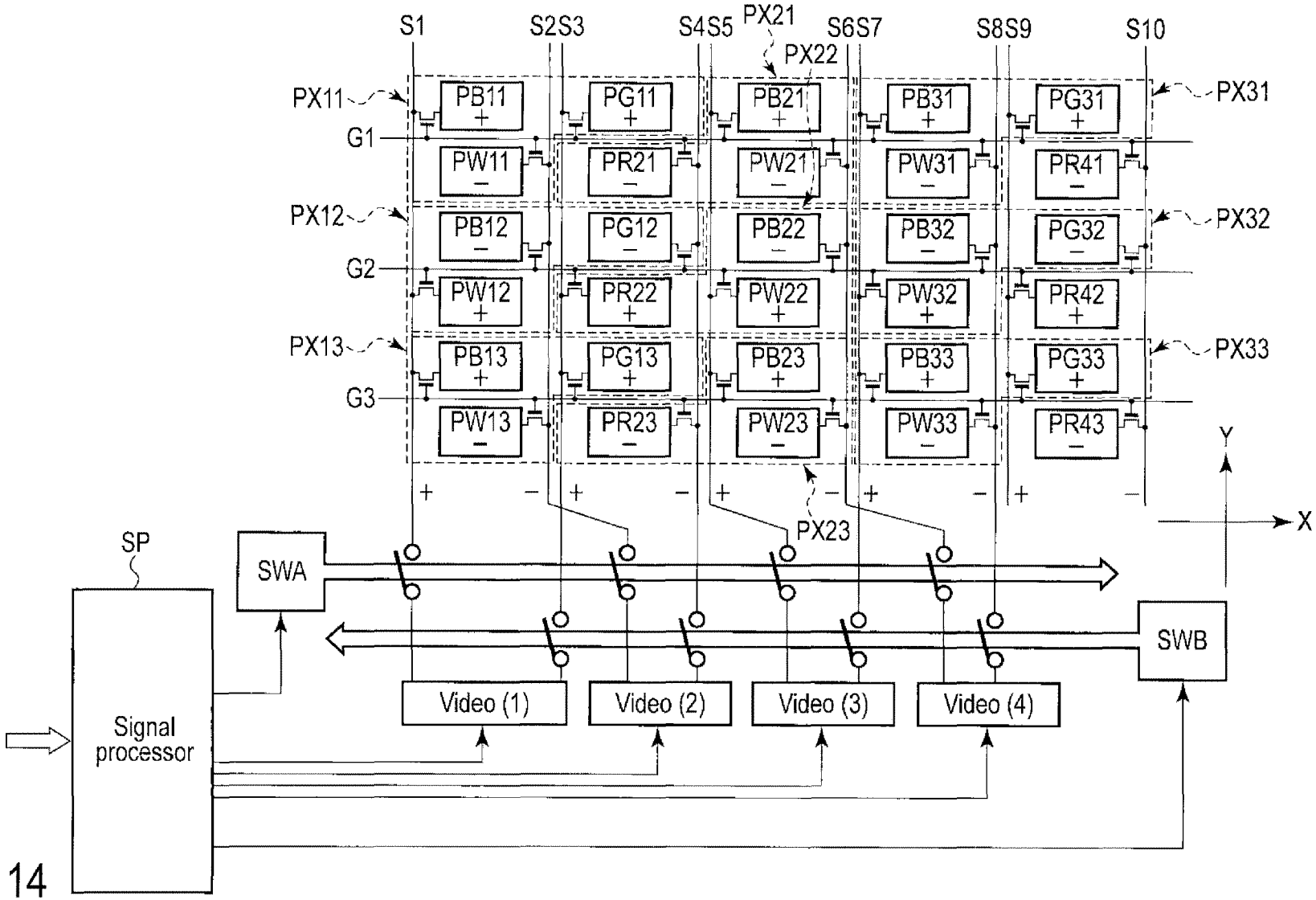
FIG. 14 is an illustration schematically showing a relationship between yet another pixel layout in the display area, and polarities of video signals written to respective pixels.

FIG. 14 is an illustration schematically showing a relationship between yet another pixel layout in the display area, and polarities of video signals written to respective pixels.

The layout of the main pixels PX11 to PX13, PX21 to PX23 and PX31 to PX33 is the same as that shown in the figure. The main pixel PX11 includes the sub-pixels PB11, PW11 and PG11. The main pixel PX21 includes the sub-pixels PR21, PB21 and PW21. The main pixel PX12 includes the sub-pixels PW12, PB12 and PG12. The main pixel PR22 includes the sub-pixels PR22, PW22 and PB22. The main pixel PX13 includes the sub-pixels PB13, PW13 and PG13. The main pixel PX23 includes the sub-pixels PR23, PB23 and PW23.

In the example illustrated, the sub-pixels PB11, PG11 and PB21 are arranged in the first direction X. The sub-pixels PW11, PR21 and PW21 are arranged in the first direction X. The sub-pixels PB12, PG12 and PB22 are arranged in the first direction X. The sub-pixels PW12, PR22 and PW22 are arranged in the first direction X. The sub-pixels PB11, PW11, PB12 and PW12 are located between the signal lines S1 and S2, and arranged in the second direction Y. The sub-pixels PG11, PR21, PG12 and PR22 are located between the signal lines S3 and S4, and arranged in the second direction Y. The sub-pixels PB21, PW21, PB22 and PW22 are located between the signal lines S5 and S6, and arranged in the second direction Y. The scanning line G1 is located between the sub-pixels PB11 and PW11, between the sub-pixels PG11 and PR21, and between the sub-pixels PB21 and PW21. The scanning line G2 is located between the sub-pixels PB12 and PW12, between the sub-pixels PG12 and PR22, and between the sub-pixels PB22 and PW22. Each of the sub-pixels shown in the figure is in a laterally elongated shape (rectangular shape) extending in the first direction X. In addition, the sub-pixels shown in the figure are formed in the same size, but some of the sub-pixels may be formed to be larger or smaller than the other sub-pixels.

Two main pixels arranged in the first direction X function as a pair of unit pixels and share sub-pixels of colors removed from the respective main pixels. In the example illustrated, when the unit pixel composed of the main pixels PX11 and PX21 is noticed, a red sub-pixel is removed from the main pixel PX11 while the main pixel PX21 includes the sub-pixel PR21, and a green sub-pixel is removed from the main pixel PX21 while the main pixel PX11 includes the sub-pixel PG11. In other words, the green sub-pixel PG11 and the red sub-pixel PR21 are shared in the unit pixel composed of the main pixels PX11 and PX21. Moreover, the sub-pixels PG11 and PG21 located between the signal lines S3 and S4 are arranged in the second direction Y.

In the main pixel PX11, the sub-pixel PB11 is electrically connected with the scanning line G1 and the signal line S1. The sub-pixel PW11 is electrically connected with the scanning line G1 and the signal line S2. The sub-pixel PG11 is electrically connected with the scanning line G1 and the signal line S3. The main pixels PX13, PX31 and PX33 are constituted similarly to the main pixel PX11.

In the main pixel PX21, the sub-pixel PR21 is electrically connected with the scanning line G1 and the signal line S4. The sub-pixel PB21 is electrically connected with the scanning line G1 and the signal line S5. The sub-pixel PW21 is electrically connected with the scanning line G1 and the signal line S6. The main pixel PX23 is constituted similarly to the main pixel PX21.

In the main pixel PX12, the sub-pixel PW12 is electrically connected with the scanning line G2 and the signal line S1. The sub-pixel PB12 is electrically connected with the scanning line G2 and the signal line S2. The sub-pixel PG12 is electrically connected with the scanning line G2 and the signal line S4. The main pixel PX32 is constituted similarly to the main pixel PX12.

In the main pixel PX22, the sub-pixel PR22 is electrically connected with the scanning line G2 and the signal line S3. The sub-pixel PW22 is electrically connected with the scanning line G2 and the signal line S5. The sub-pixel PB22 is electrically connected with the scanning line G2 and the signal line S6.

In one frame period, positive-polarity video signals (+) are supplied to the signal lines S1, S3, S5, S7 and S9, and negative-polarity video signals (−) are supplied to the signal lines S2, S4, S6, S8 and S10.

In the horizontal scanning period in which the scanning line G1 is selected, the video signal (+) is written to the sub-pixel PB11 via the signal line S1, the video signal (−) is written to the sub-pixel PW11 via the signal line S2, the video signal (+) is written to the sub-pixel PG11 via the signal line S3, the video signal (−) is written to the sub-pixel PR21 via the signal line S4, the video signal (+) is output to the sub-pixel PB21 via the signal line S5, the video signal (−) is written to the sub-pixel PW21 via the signal line S6, the video signal (+) is written to the sub-pixel PB31 via the signal line S7, the video signal (−) is written to the sub-pixel PW31 via the signal line S8, the video signal (+) is output to the sub-pixel PG31 via the signal line S9, and the video signal (−) is written to the sub-pixel PR41 via the signal line S10. It should be noted that in the horizontal scanning period in which the scanning line G3 is selected, the video signal is written to the scanning line S3, similarly to the horizontal scanning period in which the scanning line G1 is selected.

In the horizontal scanning period in which the scanning line G2 is selected, the video signal (+) is written to the sub-pixel PW12 via the signal line S1, the video signal (−) is written to the sub-pixel PB12 via the signal line S2, the video signal (+) is written to the sub-pixel PR22 via the signal line S3, the video signal (−) is written to the sub-pixel PG12 via the signal line S4, the video signal (+) is output to the sub-pixel PW22 via the signal line S5, the video signal (−) is written to the sub-pixel PB22 via the signal line S6, the video signal (+) is written to the sub-pixel PW32 via the signal line S7, the video signal (−) is written to the sub-pixel PB32 via the signal line S8, the video signal (+) is output to the sub-pixel PR42 via the signal line S9, and the video signal (−) is written to the sub-pixel PG32 via the signal line S10.

In the removing configuration shown in the figure, the processing of averaging the video signals is executed between the paired main pixels PX11 and PX21. For example, the signal processor SP executes averaging based on the video signal G11 which should be written to the green sub-pixel PG11 in the main pixel PX11 and the video signal G12 which should be written to the green sub-pixel in the main pixel PX21 (but not included in the actual main pixel PX21), and produces a corrected video signal. The corrected video signal thus produced is supplied to the signal line S3 and written to the sub-pixel PG11 in the horizontal scanning period in which the scanning line G1 is selected. Similarly to this, the signal processor SP executes averaging based on the video signal R11 which should be written to the red sub-pixel in the main pixel PX11 (but not included in the actual main pixel PX11) and the video signal R12 which should be written to the red sub-pixel PR21 in the main pixel PX21, and writes the produced corrected video signal to the sub-pixel PR21.

Figure 15:
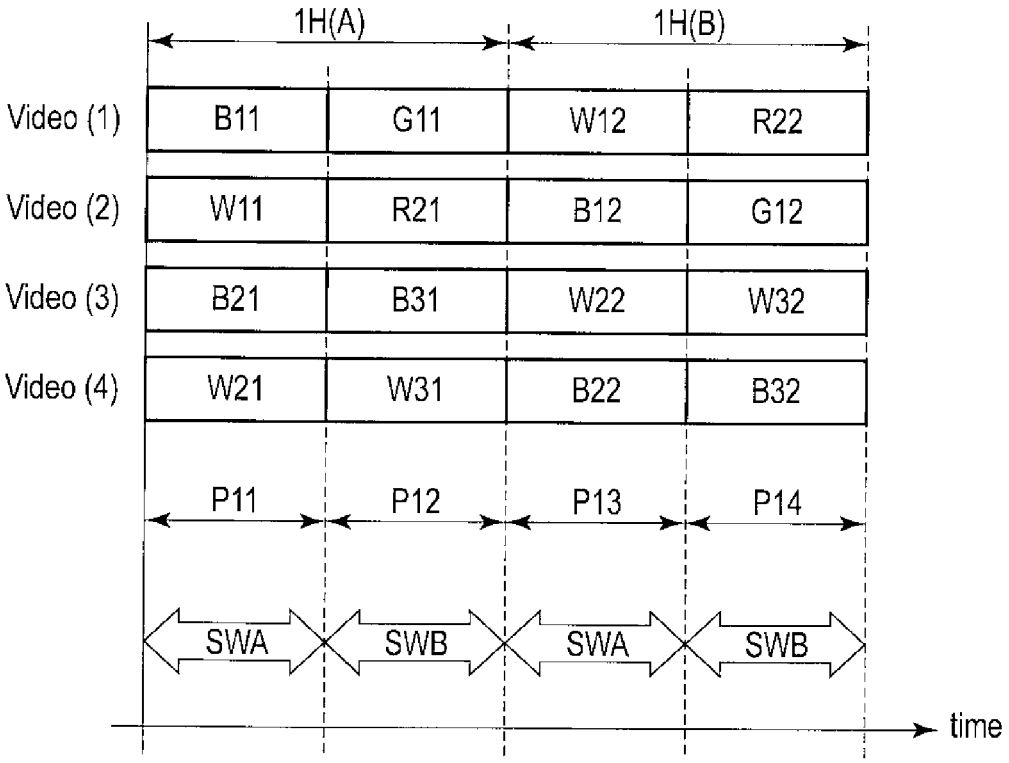
FIG. 15 is an illustration showing an example of timing of writing the video signals to the respective sub-pixels of the pixel layout shown in FIG. 14.

FIG. 15 is an illustration showing an example of timing of writing the video signals to the respective sub-pixels of the pixel layout shown in FIG. 14.

The switch SWA becomes conductive in a first period P11 of a horizontal scanning period 1H (A) in which the scanning line G1 is selected. The video signal B11 output from the output terminal Video (1) is written to the sub-pixel PB11 via the signal line S1. The video signal W11 output from the output terminal Video (2) is written to the sub-pixel PW11 via the signal line S2. The video signal B21 output from the output terminal Video (3) is written to the sub-pixel PB21 via the signal line S5. The video signal W21 output from the output terminal Video (4) is written to the sub-pixel PW21 via the signal line S6.

The switch SWB becomes conductive in a second period P12 of the horizontal scanning period 1H (A). The video signal G11 output from the output terminal Video (1) is written to the sub-pixel PG11 via the signal line S3. The video signal R21 output from the output terminal Video (2) is written to the sub-pixel PR21 via the signal line S4. The video signal B31 output from the output terminal Video (3) is written to the sub-pixel PB31 via the signal line S7. The video signal W31 output from the output terminal Video (4) is written to the sub-pixel PW31 via the signal line S8.

The switch SWA becomes conductive in a third period P13 of a horizontal scanning period 1H (B) in which the scanning line G2 is selected. The video signal W12 output from the output terminal Video (1) is written to the sub-pixel PW12 via the signal line S1. The video signal B12 output from the output terminal Video (2) is written to the sub-pixel PB12 via the signal line S2. The video signal W22 output from the output terminal Video (3) is written to the sub-pixel PW22 via the signal line S5. The video signal B22 output from the output terminal Video (4) is written to the sub-pixel PB22 via the signal line S6.

The switch SWB becomes conductive in a fourth period P14 of the horizontal scanning period 1H (B). The video signal R22 output from the output terminal Video (1) is written to the sub-pixel PR22 via the signal line S3. The video signal G12 output from the output terminal Video (2) is written to the sub-pixel PG12 via the signal line S4. The video signal W32 output from the output terminal Video (3) is written to the sub-pixel PW32 via the signal line S7. The video signal B32 output from the output terminal Video (4) is written to the sub-pixel PB32 via the signal line S8.

In this configuration example, too, the same advantages as those of the above-explained configuration examples can be obtained.

Figure 16:
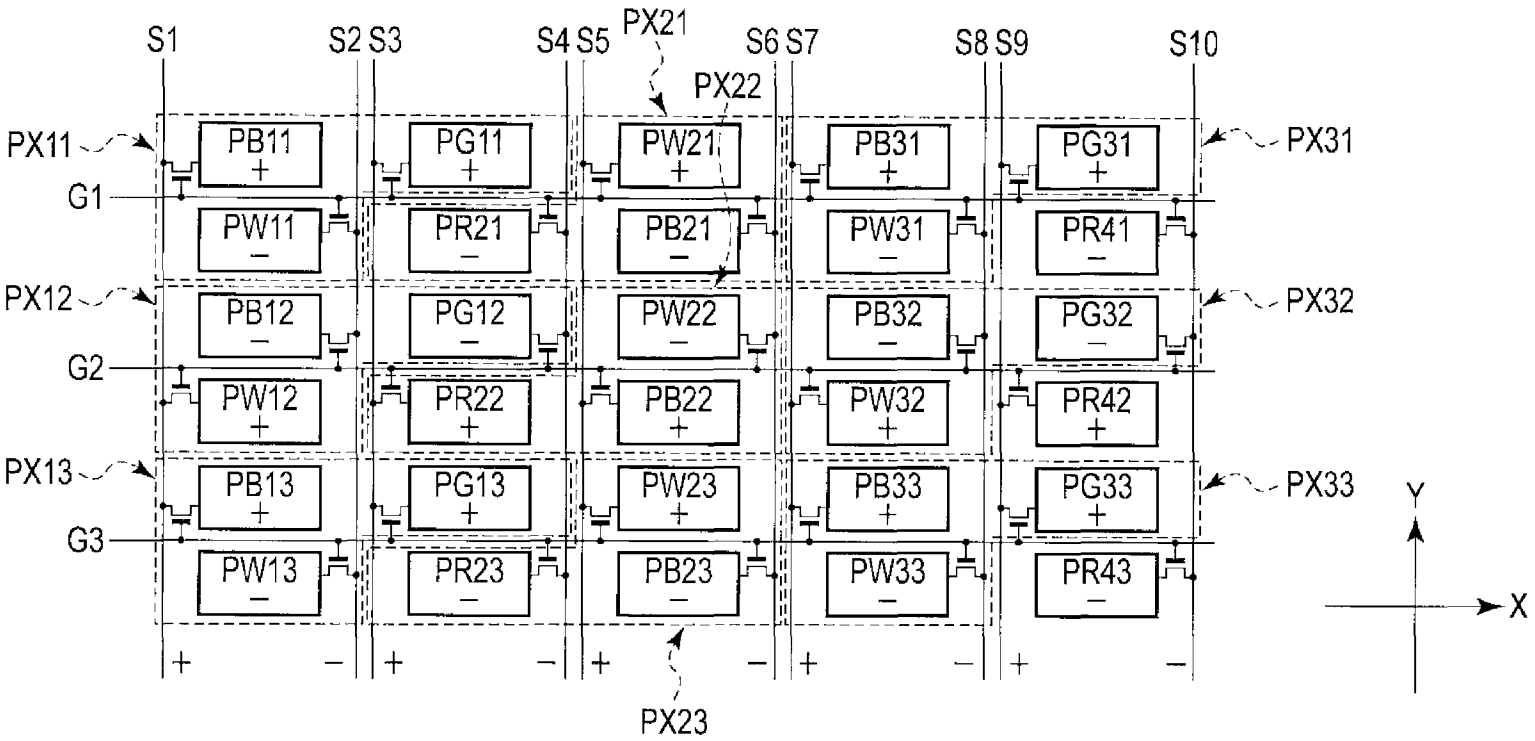
FIG. 16 is an illustration schematically showing a relationship between yet another pixel layout in the display area, and the polarities of the video signals written to the respective pixels.

FIG. 16 is an illustration schematically showing a relationship between yet another pixel layout in the display area, and the polarities of the video signals written to the respective pixels.

The example shown in FIG. 16 is different from the example shown in FIG. 14 with respect to an array of blue and white sub-pixels, and is the same as the example shown in FIG. 14 with respect to the layout of the other sub-pixels. More specifically, the sub-pixels PB11, PW21 and PB31 are arranged in the first line and the sub-pixels PW11, PB21 and PW31 are arranged in the second line, in the example shown in FIG. 16, while the sub-pixels PB11, PB21 and PB31 are arranged in the first line and the sub-pixels PW11, PW21 and PW31 are arranged in the second line, in the pixel layout shown in FIG. 14. In other words, the blue and white sub-pixels are arrayed so as not to be arranged in the same line along the first direction X.

The blue and white sub-pixels have been explained, but a pixel layout in which the red and green sub-pixels are not arranged in the same line along the first direction X can also be adopted.

In this configuration example, too, the same advantages as those of the above-explained configuration examples can be obtained.

Figure 17:
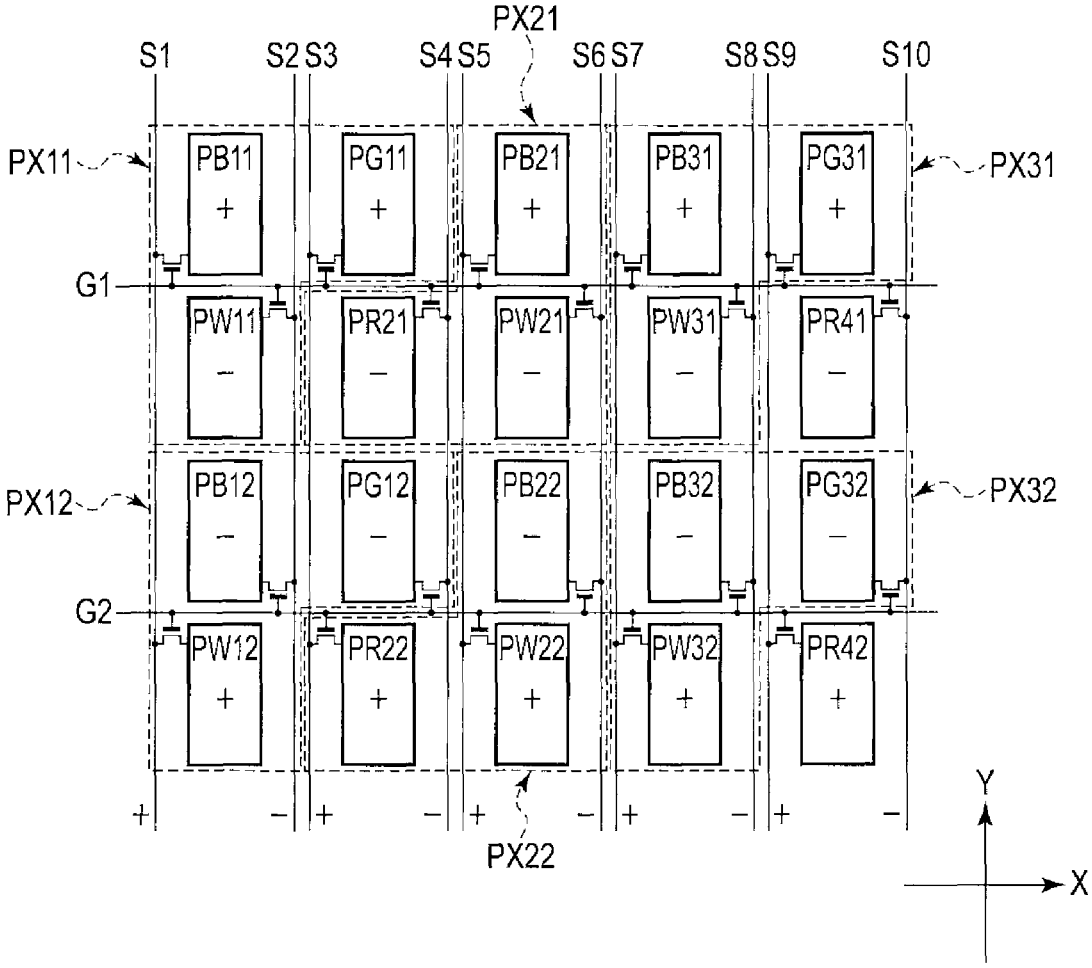
FIG. 17 is an illustration schematically showing a relationship between yet another pixel layout in the display area, and the polarities of the video signals written to the respective pixels.

FIG. 17 is an illustration schematically showing a relationship between yet another pixel layout in the display area, and the polarities of the video signals written to the respective pixels.

The example shown in FIG. 17 is different from the example shown in FIG. 14 with respect to a feature that each of the sub-pixels is in a longitudinally elongated shape extending in the second direction Y, and is the same as the example shown in FIG. 14 with respect to the other features such as the layout of the sub-pixels, and connection of the scanning lines and the signal lines with the sub-pixels.

In this configuration example, too, the same advantages as those of the above-explained configuration examples can be obtained.

Figure 18:
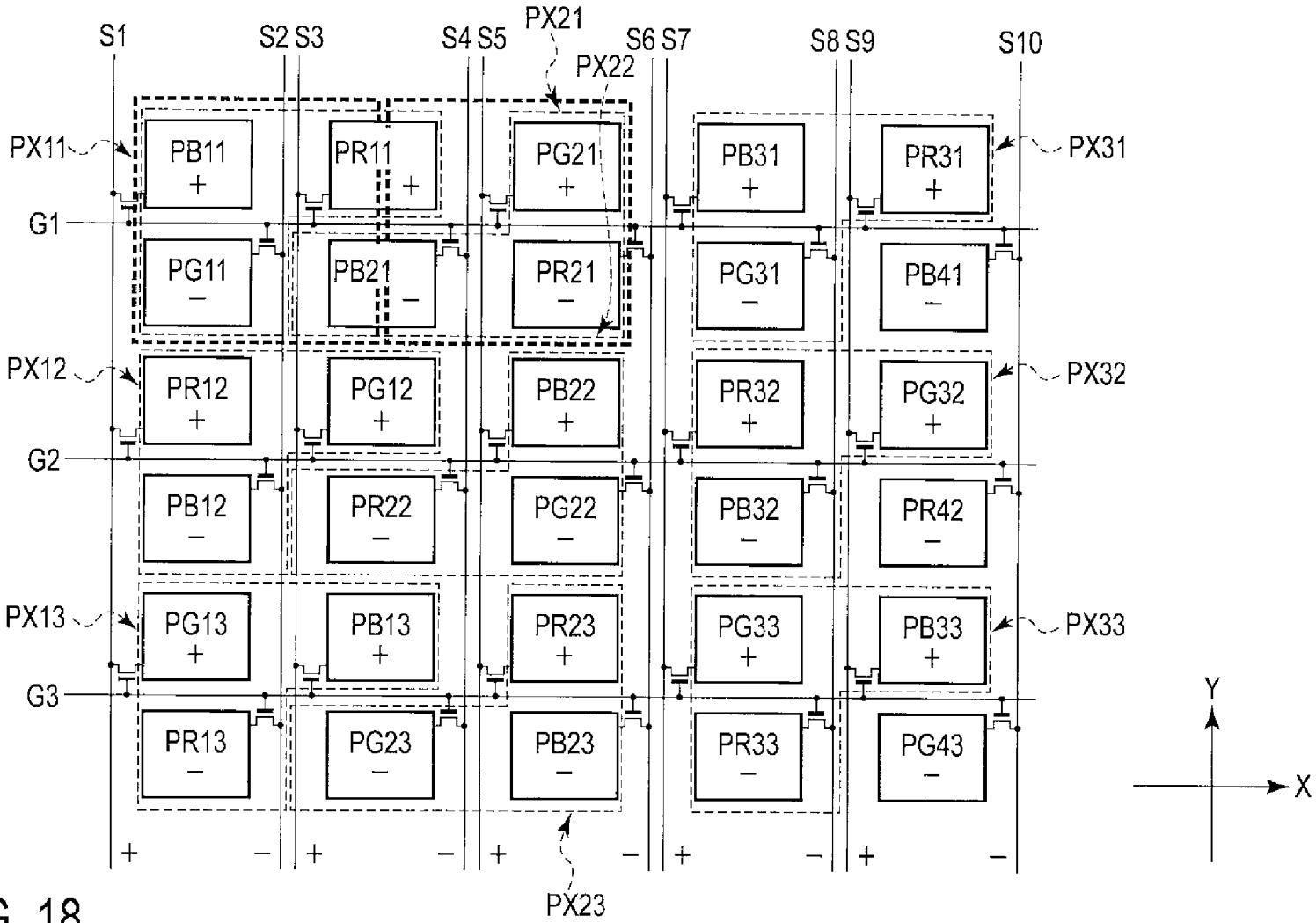
FIG. 18 is an illustration schematically showing a relationship between yet another pixel layout in the display area, and the polarities of the video signals written to the respective pixels.

FIG. 18 is an illustration schematically showing a relationship between yet another pixel layout in the display area, and the polarities of the video signals written to the respective pixels.

The layout of the main pixels PX11 to PX13, PX21 to PX23 and PX31 to PX33 is the same as that shown in the figure. The main pixel PX11 includes the sub-pixels PB11, PG11 and PR11. The main pixel PX21 includes the sub-pixels PB21, PG21 and PR21. The main pixel PX12 includes the sub-pixels PR12, PB12 and PG12. The main pixel PR22 includes the sub-pixels PR22, PB22 and PG22. The main pixel PX13 includes the sub-pixels PG13, PR13 and PB13. The main pixel PX23 includes the sub-pixels PG23, PR23 and PB23.

In the example illustrated, the sub-pixels PB11, PR11 and PG21 are arranged in the first direction X. The sub-pixels PG11, PB21 and PR21 are arranged in the first direction X. The sub-pixels PR12, PG12 and PB22 are arranged in the first direction X. The sub-pixels PB12, PR22 and PG22 are arranged in the first direction X. The sub-pixels PB11, PG11, PR12 and PB12 are located between the signal lines S1 and S2, and arranged in the second direction Y. The sub-pixels PR11, PB21, PG12 and PR22 are located between the signal lines S3 and S4, and arranged in the second direction Y. The sub-pixels PG21, PR21, PB22 and PG22 are located between the signal lines S5 and S6, and arranged in the second direction Y. The scanning line G1 is located between the sub-pixels PB11 and PG11, between the sub-pixels PR11 and PB21, and between the sub-pixels PG21 and PR21. The scanning line G2 is located between the sub-pixels PR12 and PB12, between the sub-pixels PG12 and PR22, and between the sub-pixels PB22 and PG22. Each of the sub-pixels shown in the figure is in a laterally elongated shape (rectangular shape) extending in the first direction X. In addition, the sub-pixels shown in the figure are formed in the same size, but some of the sub-pixels may be formed to be larger or smaller than the other sub-pixels.

In the main pixel PX11, the sub-pixel PB11 is electrically connected with the scanning line G1 and the signal line S1. The sub-pixel PG11 is electrically connected with the scanning line G1 and the signal line S2. The sub-pixel PR11 is electrically connected with the scanning line G1 and the signal line S3. It should be noted that the main pixel PX31 is constituted similarly to the main pixel PX11.

In the main pixel PX21, the sub-pixel PB21 is electrically connected with the scanning line G1 and the signal line S4. The sub-pixel PG21 is electrically connected with the scanning line G1 and the signal line S5. The sub-pixel PR21 is electrically connected with the scanning line G1 and the signal line S6.

In the main pixel PX12, the sub-pixel PR12 is electrically connected with the scanning line G2 and the signal line S1. The sub-pixel PB12 is electrically connected with the scanning line G2 and the signal line S2. The sub-pixel PG12 is electrically connected with the scanning line G2 and the signal line S3. The main pixel PX32 is constituted similarly to the main pixel PX12.

In the main pixel PX22, the sub-pixel PR22 is electrically connected with the scanning line G2 and the signal line S4. The sub-pixel PB22 is electrically connected with the scanning line G2 and the signal line S5. The sub-pixel PG22 is electrically connected with the scanning line G2 and the signal line S6.

In the main pixel PX13, the sub-pixel PG13 is electrically connected with the scanning line G3 and the signal line S1. The sub-pixel PR13 is electrically connected with the scanning line G3 and the signal line S2. The sub-pixel PB13 is electrically connected with the scanning line G3 and the signal line S3. It should be noted that the main pixel PX33 is constituted similarly to the main pixel PX13.

In the main pixel PX23, the sub-pixel PG23 is electrically connected with the scanning line G3 and the signal line S4. The sub-pixel PR23 is electrically connected with the scanning line G3 and the signal line S5. The sub-pixel PB23 is electrically connected with the scanning line G3 and the signal line S6.

In one frame period, positive-polarity video signals (+) are supplied to the signal lines S1, S3, S5, S7 and S9, and negative-polarity video signals (−) are supplied to the signal lines S2, S4, S6, S8 and S10.

In the horizontal scanning period in which the scanning line G1 is selected, the video signal (+) is written to the sub-pixel PB11 via the signal line S1, the video signal (−) is written to the sub-pixel PG11 via the signal line S2, the video signal (+) is written to the sub-pixel PR11 via the signal line S3, the video signal (−) is written to the sub-pixel PB21 via the signal line S4, the video signal (+) is output to the sub-pixel PG21 via the signal line S5, the video signal (−) is written to the sub-pixel PR21 via the signal line S6, the video signal (+) is written to the sub-pixel PB31 via the signal line S7, the video signal (−) is written to the sub-pixel PG31 via the signal line S8, the video signal (+) is output to the sub-pixel PR31 via the signal line S9, and the video signal (−) is written to the sub-pixel PB41 via the signal line S10.

In the horizontal scanning period in which the scanning line G2 is selected, the video signal (+) is written to the sub-pixel PR12 via the signal line S1, the video signal (−) is written to the sub-pixel PB12 via the signal line S2, the video signal (+) is written to the sub-pixel PG12 via the signal line S3, the video signal (−) is written to the sub-pixel PR22 via the signal line S4, the video signal (+) is output to the sub-pixel PB22 via the signal line S5, the video signal (−) is written to the sub-pixel PG22 via the signal line S6, the video signal (+) is written to the sub-pixel PR32 via the signal line S7, the video signal (−) is written to the sub-pixel PB32 via the signal line S8, the video signal (+) is output to the sub-pixel PG32 via the signal line S9, and the video signal (−) is written to the sub-pixel PR42 via the signal line S10.

In the horizontal scanning period in which the scanning line G3 is selected, the video signal (+) is written to the sub-pixel PG13 via the signal line S1, the video signal (−) is written to the sub-pixel PR13 via the signal line S2, the video signal (+) is written to the sub-pixel PB13 via the signal line S3, the video signal (−) is written to the sub-pixel PG23 via the signal line S4, the video signal (+) is output to the sub-pixel PR23 via the signal line S5, the video signal (−) is written to the sub-pixel PB23 via the signal line S6, the video signal (+) is written to the sub-pixel PG33 via the signal line S7, the video signal (−) is written to the sub-pixel PR33 via the signal line S8, the video signal (+) is output to the sub-pixel PB33 via the signal line S9, and the video signal (−) is written to the sub-pixel PG43 via the signal line S10.

Each of the sub-pixels is in a laterally elongated shape extending in the first direction X and, if the main pixels PX11 and PX21 are replaced with square unit pixels UP1 and UP2, respectively, the sub-pixel PR11 extends from the main pixel PX11 toward the main pixel PX21 and the sub-pixel PB21 extends from the main pixel PX21 toward the main pixel PX11. The corrected video signal produced by, for example, the above-explained averaging is written to the sub-pixel thus extending over two unit pixels.

In this configuration example, too, the same advantages as those of the above-explained configuration examples can be obtained. In addition, by adopting the pixel layout in which the sub-pixels of each of red, green and blue do not locally exist but are distributed comparatively uniformly, non-uniformity in display which is shaped in stripes can hardly be recognized visually when the monochromatic display is executed. Moreover, since the polarities of the video signals written to the sub-pixels of each color are not unbalanced in the same frame period, flicker can be reduced when the monochromatic display is executed. Furthermore, the width of each sub-pixel along the first direction X can be increased, which is advantageous to high-definition, as compared with the stripe-shaped pixel layout shown in FIG. 5 or the like.

Each of the sub-pixels is in a laterally elongated shape extending in the first direction X in the example shown in FIG. 18, but may be in a longitudinally elongated shape extending in the second direction Y as shown in FIG. 17.

Figure 19:
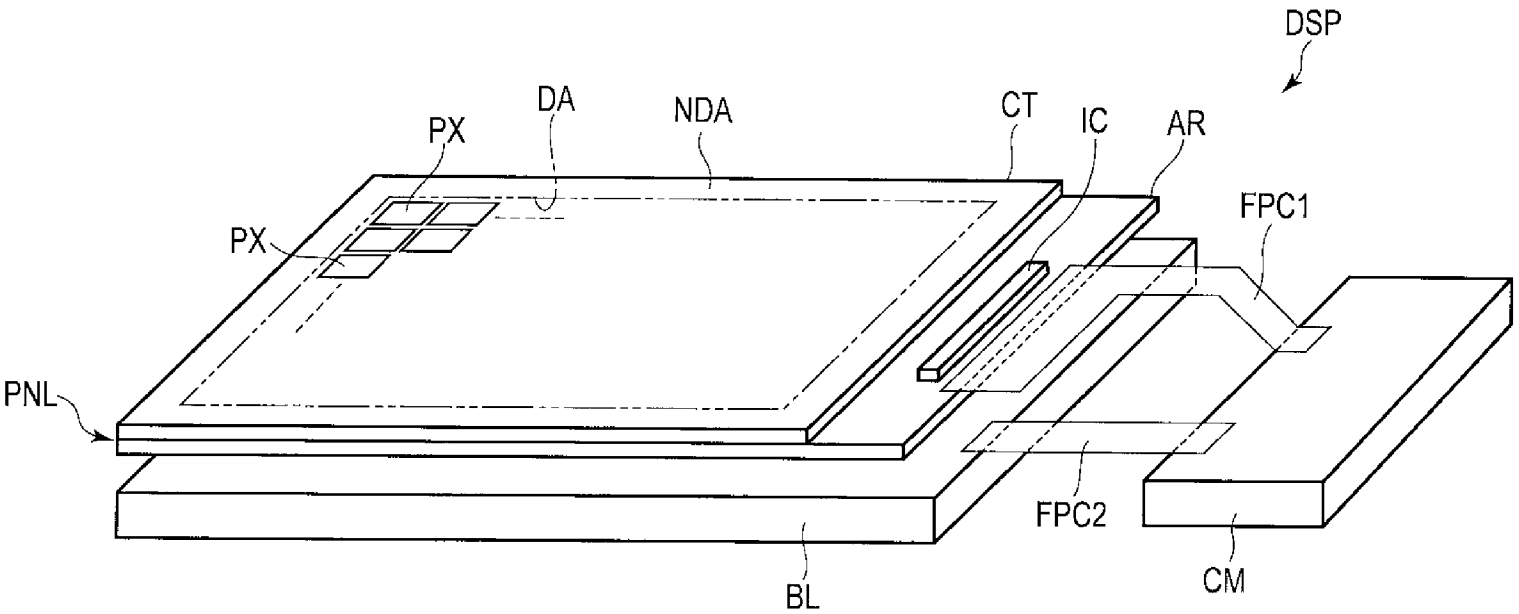
FIG. 19 is a perspective view schematically showing another configuration of a liquid crystal display device DSP.

FIG. 19 is a perspective view schematically showing another configuration of a liquid crystal display device DSP.

The liquid crystal display device DSP comprises an active matrix type liquid crystal display panel PNL, a driving IC chip IC which drives the liquid crystal display panel PNL, a backlight unit BL which illuminates the liquid crystal display panel PNL, a control module CM, flexible printed-circuit boards FPC1 and FPC2, and the like.

The backlight unit BL is disposed at the rear surface side of the liquid crystal display panel PNL. Various types of units are applicable as the backlight unit BL, but the detailed explanations are omitted. The flexible printed-circuit board FPC1 connects the liquid crystal display panel PNL with the control module CM. The flexible printed-circuit board FPC2 connects the backlight unit BL with the control module CM.

The liquid crystal display panel PNL is a transmissive display panel having a transmissive display function to display an image by selectively transmitting the light from the backlight unit BL by each main pixel PX or a transreflective display panel having the transmissive display function and the reflective display function. Any one of the above-explained examples can be applied as the layout of the sub-pixels included in each main pixel PX.

As explained above, the present embodiment can provide the display device capable of improving the display quality and reducing the energy consumption.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a first pixel line including a first sub-pixel and a second sub-pixel arranged in a first direction;

a second pixel line adjacent to the first pixel line in a second direction crossing the first direction, the second pixel line including a third sub-pixel and a fourth sub-pixel arranged in the first direction;

a third pixel line adjacent to the second pixel line in the second direction, the third pixel line including a fifth sub-pixel and a sixth sub-pixel arranged in the first direction;

a plurality of scanning lines including first and second scanning lines arranged in the second direction;

a plurality of signal lines including first, second, and third signal lines arranged in the first direction; and a display driver supplying a video signal to each of the sub-pixels via the signal lines, a polarity of each of the video signals supplied to the first signal line and the third signal line being a first polarity, a polarity of each of the video signals supplied to the second signal line being a second polarity opposite to the first polarity, wherein the first sub-pixel is electrically connected with the first scanning line and the first signal line, the second sub-pixel is electrically connected with the first scanning line and the third signal line, the third sub-pixel is electrically connected with the first scanning line and the second signal line, the fourth sub-pixel is electrically connected with the second scanning line and the second signal line, the fifth sub-pixel is electrically connected with the second scanning line and the first signal line, the sixth sub-pixel is electrically connected with the second scanning line and the third signal line, the first sub-pixel and the fifth sub-pixel exhibit a first color, and have the video signal of the first polarity, the second sub-pixel and the sixth sub-pixel exhibit a second color different from the first color, and have the video signal of the first polarity, the third sub-pixel exhibits a third color different from the first and the second colors, the fourth sub-pixel exhibits a fourth color different from the first to third colors, and the third sub-pixel and the fourth sub-pixel have the video signal of the second polarity.

2. The display device according to claim 1, wherein the plurality of signal lines further include a fourth signal line, the display driver comprises:

a signal processor which outputs the video signals, a line buffer which temporarily stores some of the video signals output from the signal processor, a first output terminal and a second output terminal which are electrically connected to the signal processor and the line buffer, a first switch interposed between the first signal line and the first output terminal and between the second signal line and the second output terminal, and a second switch interposed between the third signal line and the first output terminal and between the fourth signal line and the second output terminal, and the display driver causes the first switch and second switch to be conductive in different periods of the horizontal scanning period, and outputs the video signals stored in the line buffer or the video signals directly output from the signal processor to the respective first to fourth signal lines.

3. The display device according to claim 1, wherein the second signal line is located between the first and second sub-pixels.

4. The display device according to claim 1, wherein the second signal line is located between the first and third signal lines.

5. The display device according to claim 1, wherein a first main pixel includes the first, second, and third sub-pixels, and a second mail pixel includes the fourth, fifth, and sixth sub-pixels.

6. The display device according to claim 1, wherein processing of averaging the video signals is executed between the first and second pixels.

7. A display device comprising:

a first pixel line including a first sub-pixel and a second sub-pixel arranged in a first direction;

a second pixel line adjacent to the first pixel line in a second direction crossing the first direction, the second pixel line including a third sub-pixel and a fourth sub-pixel arranged in the first direction;

a third pixel line adjacent to the second pixel line in the second direction, the third pixel line including a fifth sub-pixel and a sixth sub-pixel arranged in the first direction;

a plurality of scanning lines including first and second scanning lines arranged in the second direction;

a plurality of signal lines including first, second, third, and fourth signal lines arranged in the first direction; and a display driver supplying a video signal to each of the sub-pixels via the signal lines, a polarity of each of the video signals supplied to the first signal line and the third signal line being a first polarity, a polarity of each of the video signals supplied to the second signal line being a second polarity opposite to the first polarity, wherein the first sub-pixel is electrically connected with the first scanning line and the second signal line, the second sub-pixel is electrically connected with the first scanning line and the third signal line, the third sub-pixel is electrically connected with the first scanning line and the first signal line, the fourth sub-pixel is electrically connected with the second scanning line and the fourth signal line, the fifth sub-pixel is electrically connected with the second scanning line and the second signal line, the sixth sub-pixel is electrically connected with the second scanning line and the third signal line, the first sub-pixel and the fifth sub-pixel exhibit a first color, and have the video signal of the first polarity, the second sub-pixel and the sixth sub-pixel exhibit a second color different from the first color, and have the video signal of the first polarity, the third sub-pixel exhibits a third color different from the first and the second colors, the fourth sub-pixel exhibits a fourth color different from the first to third colors, and the third sub-pixel and the fourth sub-pixel have the video signal of the second polarity.

8. The display device according to claim 7, wherein the display driver comprises:

a signal processor which outputs the video signals, a line buffer which temporarily stores some of the video signals output from the signal processor, a first output terminal and a second output terminal which are electrically connected to the signal processor and the line buffer, a first switch interposed between the first signal line and the first output terminal and between the second signal line and the second output terminal, and a second switch interposed between the third signal line and the first output terminal and between the fourth signal line and the second output terminal, and the display driver causes the first switch and second switch to be conductive in different periods of the horizontal scanning period, and outputs the video signals stored in the line buffer or the video signals directly output from the signal processor to the respective first, second, third, and fourth signal lines.

9. The display device according to claim 7, wherein the second and third signal lines are located between the first and second sub-pixels, and the second signal line is located between the first and third signal lines.

10. The display device according to claim 7, wherein the second and third signal lines are located between the first and fourth signal lines, and the second signal line is located between the first and third signal lines.

11. The display device according to claim 7, wherein a first main pixel includes the first, second, and third sub-pixels, and a second mail pixel includes the fourth, fifth, and sixth sub-pixels.

12. The display device according to claim 1, wherein processing of averaging the video signals is executed between the first and second pixels.

* * * * *